US011642285B2

(12) United States Patent
Denenburg et al.

(10) Patent No.: US 11,642,285 B2
(45) Date of Patent: May 9, 2023

(54) DUAL VIAL ADAPTER ASSEMBLAGES INCLUDING TWIN VENTED FEMALE VIAL ADAPTERS

(71) Applicant: West Pharma. Services IL, Ltd., Ra'anana (IL)

(72) Inventors: Igor Denenburg, Gedera (IL); Amir Lev, Kfar Saba (IL); Uri David, Nes Ziona (IL)

(73) Assignee: WEST PHARMA. SERVICES IL, LTD., Ra'anana (IL)

( * ) Notice: Subject to any disclaimer, the term of this patent is extended or adjusted under 35 U.S.C. 154(b) by 378 days.

(21) Appl. No.: 16/651,560

(22) PCT Filed: Sep. 20, 2018

(86) PCT No.: PCT/IL2018/051061
§ 371 (c)(1),
(2) Date: Mar. 27, 2020

(87) PCT Pub. No.: WO2019/064296
PCT Pub. Date: Apr. 4, 2019

(65) Prior Publication Data

US 2020/0261317 A1 Aug. 20, 2020

(30) Foreign Application Priority Data

Sep. 29, 2017 (IL) ..... 254802

(51) Int. Cl.
*A61J 1/20* (2006.01)
*A61J 1/14* (2023.01)

(52) U.S. Cl.
CPC ..... *A61J 1/2096* (2013.01); *A61J 1/1406* (2013.01); *A61J 1/2013* (2015.05); *A61J 1/2041* (2015.05); *A61J 1/2048* (2015.05); *A61J 1/2082* (2015.05)

(58) Field of Classification Search
CPC ..... A61J 1/2096; A61J 1/2089; A61J 1/1406; A61J 1/2055; A61J 1/20; A61J 1/2058;
(Continued)

(56) References Cited

U.S. PATENT DOCUMENTS 62,333 A 2/1867 Holl
247,975 A 10/1881 Wickes
(Continued)

FOREIGN PATENT DOCUMENTS

CA 2946559 A1 10/2015
CN 1636605 A 7/2005
(Continued)

OTHER PUBLICATIONS

Int'l Search Report dated Jul. 27, 2007 in Int'l Application No. PCT/IL2007/000343.
(Continued)

*Primary Examiner* — Erich G Herbermann
*Assistant Examiner* — Seth Han
(74) *Attorney, Agent, or Firm* — Blank Rome LLP

(57) ABSTRACT

Dual vial adapter assemblages having a triple component construction as follows: a first vented female vial adapter for telescopic mounting on a drug vial, a second vented female vial adapter for telescopic mounting on a liquid vial and a tubular liquid transfer coupler for coupling the first vented female vial adapter and the second vented female vial adapter for establishing a dual sealed lumen arrangement therebetween. The dual sealed lumen arrangement includes a central sealed liquid lumen for gravitational flow of liquid contents from a liquid vial to a drug vial and a sealed air lumen radial outward from the central sealed liquid lumen for venting air displaced from the drug vial to the liquid vial
(Continued)

for assisting the gravitational flow of liquid contents by creating a closed system between the liquid vial and the drug vial.

10 Claims, 11 Drawing Sheets

(58) Field of Classification Search
CPC ..... A61J 1/2062; A61J 1/22; A61J 1/2027; A61J 1/1481; A61J 1/1425; A61J 1/2006; A61J 1/2003; A61J 1/201; A61J 1/2048; A61J 1/2072; A61J 1/2013; A61J 1/2041; A61J 1/2082; A61M 5/1782; A61M 5/162; A61M 5/3202; A61M 2039/1077; A61M 39/10
See application file for complete search history.

(56) References Cited

U.S. PATENT DOCUMENTS 254,444 A 2/1882 Vogel
300,060 A 6/1884 Ford
1,021,681 A 3/1912 Jennings
1,704,817 A 3/1929 Ayers
1,930,944 A 10/1933 Schmitz, Jr.
2,247,975 A 7/1941 Tinnerman
2,326,490 A 8/1943 Perelson
2,560,162 A 7/1951 Garwood
2,748,769 A 6/1956 Huber
2,830,587 A 4/1958 Everett
2,931,668 A 4/1960 Baley
2,968,497 A 1/1961 Treleman
3,007,461 A 11/1961 Armbrust
3,021,325 A 2/1962 Fancher et al.
3,059,643 A 10/1962 Barton
3,066,688 A 12/1962 William
D198,499 S 6/1964 Harautuneian
3,225,763 A 12/1965 Waterman
3,254,444 A 6/1966 Gordon
3,277,893 A 10/1966 Clark
3,308,822 A 3/1967 De Luca
3,484,849 A 12/1969 Huebner et al.
3,618,637 A 11/1971 Santomier
3,684,992 A 8/1972 Huguet et al.
3,752,598 A 8/1973 Bowers et al.
3,757,981 A 9/1973 Harris, Sr. et al.
3,782,365 A 1/1974 Pinna
3,788,524 A 1/1974 Davis et al.
3,822,700 A 7/1974 Pennington
3,826,261 A 7/1974 Killinger
3,872,992 A 3/1975 Larson
3,882,909 A * 5/1975 Ogle ..... A61J 1/06 141/286
3,885,607 A 5/1975 Peltier
3,938,520 A 2/1976 Scislowicz et al.
3,957,052 A 5/1976 Topham
3,977,555 A 8/1976 Larson
3,993,063 A 11/1976 Larrabee
4,020,839 A 5/1977 Klapp
4,026,128 A 5/1977 Blanco
4,051,852 A 10/1977 Villari
D247,975 S 5/1978 Luther
D248,568 S 7/1978 Ismach
4,109,670 A 8/1978 Slagel
4,121,585 A 10/1978 Becker, Jr.
4,161,178 A 7/1979 Genese
D254,111 S 2/1980 Schaefer
4,187,848 A 2/1980 Taylor
D254,444 S 3/1980 Levine
4,203,067 A 5/1980 Fitzky et al.
4,203,443 A 5/1980 Genese
4,210,173 A 7/1980 Choksi et al.
D257,286 S 10/1980 Folkman
4,253,501 A 3/1981 Ogle
4,296,786 A 10/1981 Brignola
4,303,067 A 12/1981 Connolly et al.
4,312,349 A 1/1982 Cohen
4,314,586 A 2/1982 Folkman
4,328,802 A 5/1982 Curley
4,335,717 A 6/1982 Bujan et al.
D267,199 S 12/1982 Koenig
4,376,634 A 3/1983 Prior et al.
D268,871 S 5/1983 Benham et al.
4,392,850 A 7/1983 Elias et al.
D270,282 S 8/1983 Gross
4,410,321 A 10/1983 Pearson et al.
4,411,662 A 10/1983 Pearson
D271,421 S 11/1983 Fetterman
4,434,823 A 3/1984 Hudspith
4,465,471 A 8/1984 Harris et al.
4,475,915 A 10/1984 Sloane
4,493,348 A 1/1985 Lemmons
4,505,709 A 3/1985 Froning et al.
4,507,113 A 3/1985 Dunlap
D280,018 S 8/1985 Scott
4,532,969 A 8/1985 Kwaan
4,564,054 A 1/1986 Gustavsson
4,572,969 A 2/1986 Hellegaard et al.
4,573,993 A 3/1986 Hoag et al.
4,576,211 A 3/1986 Valentini et al.
4,581,014 A 4/1986 Millerd et al.
4,585,446 A 4/1986 Kempf
4,588,396 A 5/1986 Stroebel et al.
4,588,403 A 5/1986 Weiss et al.
D284,603 S 7/1986 Loignon
4,604,093 A 8/1986 Brown et al.
4,607,671 A 8/1986 Aalto et al.
4,614,437 A 9/1986 Buehler
4,638,975 A 1/1987 Iuchi et al.
4,639,019 A 1/1987 Mittleman
4,667,927 A 5/1987 Oscarsson
4,675,020 A 6/1987 McPhee
4,676,530 A 6/1987 Nordgren et al.
4,683,975 A 8/1987 Booth et al.
4,697,622 A 10/1987 Swift et al.
4,721,133 A 1/1988 Sundblom
4,729,401 A 3/1988 Raines
4,735,608 A 4/1988 Sardam
4,743,229 A 5/1988 Chu
4,743,243 A 5/1988 Vaillancourt
4,752,292 A 6/1988 Lopez et al.
4,758,235 A 7/1988 Tu
4,759,756 A 7/1988 Forman et al.
4,778,447 A 10/1988 Velde et al.
4,787,898 A 11/1988 Raines
4,797,898 A 1/1989 Martinez
D300,060 S 2/1989 Molgaard-Nielsen
4,804,366 A 2/1989 Zdeb et al.
4,826,492 A 5/1989 Magasi
4,832,690 A 5/1989 Kuu
4,834,152 A 5/1989 Howson et al.
D303,013 S 8/1989 Konopka
4,857,062 A 8/1989 Russell
4,865,592 A 9/1989 Rycroft
4,871,463 A 10/1989 Taylor et al.
4,898,209 A 2/1990 Zbed
4,909,290 A 3/1990 Coccia
4,919,596 A 4/1990 Slate et al.
4,927,423 A 5/1990 Malmborg
4,931,040 A 6/1990 Haber et al.
4,932,944 A 6/1990 Jagger et al.
4,967,797 A 11/1990 Manska
D314,050 S 1/1991 Sone
D314,622 S 2/1991 Andersson et al.
4,997,430 A 3/1991 Van der Heiden et al.
5,006,114 A 4/1991 Rogers et al.
5,013,221 A 5/1991 Fuckey
5,035,686 A 7/1991 Crittenden et al.
5,041,105 A 8/1991 D'Alo et al.
5,045,066 A 9/1991 Scheuble et al.
5,049,129 A 9/1991 Zdeb et al.
5,053,015 A 10/1991 Gross
5,061,248 A 10/1991 Sacco

(56) References Cited

U.S. PATENT DOCUMENTS 5,088,996 A 2/1992 Kopfer et al.
5,096,575 A 3/1992 Cosack
5,104,387 A 4/1992 Pokorney et al.
5,113,904 A 5/1992 Aslanian
D327,318 S 6/1992 Dudar et al.
5,122,124 A 6/1992 Novacek et al.
5,125,908 A 6/1992 Cohen
5,125,915 A 6/1992 Berry et al.
D328,788 S 8/1992 Sagae et al.
5,171,230 A 12/1992 Eland et al.
5,201,705 A 4/1993 Berglund et al.
5,201,717 A 4/1993 Wyatt et al.
5,203,771 A 4/1993 Melker et al.
5,203,775 A 4/1993 Frank et al.
5,211,638 A 5/1993 Dudar et al.
5,232,029 A 8/1993 Knox et al.
5,232,109 A 8/1993 Tirrell et al.
5,242,432 A 9/1993 DeFrank
5,247,972 A 9/1993 Tetreault
D341,420 S 11/1993 Conn
5,269,768 A 12/1993 Cheung
5,270,219 A 12/1993 DeCastro et al.
5,279,576 A 1/1994 Loo et al.
5,288,290 A 2/1994 Brody
5,300,034 A 4/1994 Behnke et al.
5,301,685 A 4/1994 Guirguis
5,304,163 A 4/1994 Bonnici et al.
5,304,165 A 4/1994 Haber et al.
5,308,483 A 5/1994 Sklar et al.
5,312,377 A 5/1994 Dalton
5,328,474 A 7/1994 Raines
D349,648 S 8/1994 Tirrell et al.
5,334,163 A 8/1994 Sinnett
5,334,179 A 8/1994 Poli et al.
5,342,346 A 8/1994 Honda et al.
5,344,417 A 9/1994 Wadsworth, Jr.
5,348,544 A 9/1994 Sweeney et al.
5,348,548 A 9/1994 Meyer et al.
5,350,372 A 9/1994 Ikeda et al.
5,364,386 A 11/1994 Fukuoka et al.
5,364,387 A 11/1994 Sweeney
5,374,264 A 12/1994 Wadsworth, Jr.
5,385,547 A 1/1995 Wong et al.
5,397,303 A 3/1995 Sancoff et al.
D357,733 S 4/1995 Matkovich
5,429,614 A 7/1995 Fowles et al.
5,433,330 A 7/1995 Yatsko et al.
5,445,630 A 8/1995 Richmond
5,445,631 A 8/1995 Uchida
D362,718 S 9/1995 Deily et al.
5,451,374 A 9/1995 Molina
5,454,805 A 10/1995 Brony
5,464,111 A 11/1995 Vacek et al.
5,464,123 A 11/1995 Scarrow
5,466,219 A 11/1995 Lynn et al.
5,466,220 A 11/1995 Brenneman
5,470,327 A 11/1995 Helgren et al.
5,471,994 A 12/1995 Guirguis
5,472,022 A 12/1995 Michel et al.
5,478,337 A 12/1995 Okamoto et al.
5,482,446 A 1/1996 Williamson et al.
5,492,147 A 2/1996 Challender et al.
5,496,274 A 3/1996 Graves et al.
D369,406 S 4/1996 Niedospial et al.
5,505,714 A 4/1996 Dassa et al.
5,509,433 A 4/1996 Paradis
5,515,871 A 5/1996 Bittner et al.
5,520,659 A 5/1996 Hedges
5,526,853 A 6/1996 McPhee et al.
5,527,306 A 6/1996 Haining
5,531,695 A 7/1996 Swisher
5,547,471 A 8/1996 Thompson et al.
5,549,577 A 8/1996 Siegel et al.
5,554,128 A 9/1996 Hedges
5,562,686 A 10/1996 Sauer et al.
5,562,696 A 10/1996 Nobles et al.
5,566,729 A 10/1996 Grabenkort et al.
5,569,191 A 10/1996 Meyer
5,573,281 A 11/1996 Keller
5,578,015 A 11/1996 Robb
5,583,052 A 12/1996 Portnoff et al.
5,584,819 A 12/1996 Kopfer
5,591,143 A 1/1997 Trombley, III et al.
D378,233 S 2/1997 Warner
5,603,706 A 2/1997 Wyatt et al.
5,607,439 A 3/1997 Yoon
5,611,576 A 3/1997 Guala
5,616,203 A 4/1997 Stevens
5,636,660 A 6/1997 Pfleiderer et al.
5,637,101 A 6/1997 Shillington
5,641,010 A 6/1997 Maier
5,645,538 A 7/1997 Richmond
5,647,845 A 7/1997 Haber et al.
5,651,776 A 7/1997 Appling et al.
5,653,686 A 8/1997 Coulter et al.
5,658,133 A 8/1997 Anderson et al.
5,672,160 A 9/1997 Osterlind et al.
5,674,195 A 10/1997 Truthan
5,676,346 A 10/1997 Leinsing
5,680,965 A 10/1997 Beck
5,685,845 A 11/1997 Grimard
D388,172 S 12/1997 Cipes
5,695,829 A 12/1997 Quincy et al.
5,699,821 A 12/1997 Paradis
5,702,019 A 12/1997 Grimard
5,718,346 A 2/1998 Weiler
5,728,087 A 3/1998 Niedospial, Jr.
D393,722 S 4/1998 Fangrow, Jr. et al.
5,738,144 A 4/1998 Rogers
5,743,312 A 4/1998 Pfeifer et al.
5,746,733 A 5/1998 Capaccio et al.
5,752,942 A 5/1998 Doyle et al.
5,755,696 A 5/1998 Caizza
5,766,211 A 6/1998 Wood et al.
5,769,138 A 6/1998 Sadowski et al.
5,772,630 A 6/1998 Ljungquist
5,772,652 A 6/1998 Zielinski
RE35,841 E 7/1998 Frank et al.
5,776,116 A 7/1998 Lopez et al.
5,782,872 A 7/1998 Muller
5,806,831 A 9/1998 Paradis
5,810,792 A 9/1998 Fangrow, Jr. et al.
5,814,020 A 9/1998 Gross
D399,559 S 10/1998 Molina
5,817,082 A 10/1998 Niedospial, Jr. et al.
5,820,621 A 10/1998 Yale et al.
5,827,262 A 10/1998 Neftel et al.
5,832,971 A 11/1998 Yale et al.
5,833,213 A 11/1998 Ryan
5,834,744 A 11/1998 Risman
5,839,715 A 11/1998 Leinsing
5,853,406 A 12/1998 Masuda et al.
D405,522 S 2/1999 Hoenig et al.
5,868,710 A 2/1999 Battiato et al.
5,871,110 A 2/1999 Grimard et al.
5,873,872 A 2/1999 Thibault et al.
5,879,337 A 3/1999 Kuracina et al.
5,879,345 A 3/1999 Aneas
5,887,633 A 3/1999 Yale et al.
5,890,610 A 4/1999 Jansen et al.
5,891,129 A 4/1999 Daubert et al.
5,893,397 A 4/1999 Peterson et al.
5,897,526 A 4/1999 Vaillancourt
5,899,468 A 5/1999 Apps et al.
5,902,280 A 5/1999 Powles et al.
5,902,298 A 5/1999 Niedospial, Jr. et al.
D410,740 S 6/1999 Molina
5,911,710 A 6/1999 Barry et al.
5,919,182 A 7/1999 Avallone
5,921,419 A 7/1999 Niedospial, Jr. et al.
5,924,584 A 7/1999 Hellstrom et al.
5,925,029 A 7/1999 Jansen et al.
5,935,112 A 8/1999 Stevens et al.
5,941,848 A 8/1999 Nishimoto et al.

(56) References Cited

U.S. PATENT DOCUMENTS 5,941,850 A 8/1999 Shah et al.
5,944,700 A 8/1999 Nguyen et al.
5,954,104 A 9/1999 Daubert et al.
5,968,022 A 10/1999 Saito
5,971,181 A 10/1999 Niedospial, Jr. et al.
5,971,965 A 10/1999 Mayer
5,989,237 A 11/1999 Fowles et al.
6,003,566 A 12/1999 Thibault et al.
6,004,278 A 12/1999 Botich et al.
6,019,750 A 2/2000 Fowles et al.
6,022,339 A 2/2000 Fowles et al.
6,036,171 A 3/2000 Weinheimer et al.
6,039,093 A 3/2000 Mrotzek et al.
6,039,302 A 3/2000 Cote, Sr. et al.
D422,357 S 4/2000 Niedospial, Jr. et al.
6,063,068 A 5/2000 Fowles et al.
D427,308 S 6/2000 Zinger
D427,309 S 6/2000 Molina
6,070,623 A 6/2000 Aneas
6,071,270 A 6/2000 Fowles et al.
6,080,132 A 6/2000 Cole et al.
D428,141 S 7/2000 Brotspies et al.
6,086,762 A 7/2000 Guala
6,089,541 A 7/2000 Weinheimer et al.
6,090,091 A 7/2000 Fowles et al.
6,090,093 A 7/2000 Thibault et al.
6,092,692 A 7/2000 Riskin
D430,291 S 8/2000 Jansen et al.
6,099,511 A 8/2000 Devos et al.
6,113,068 A 9/2000 Ryan
6,113,571 A 9/2000 Zinger et al.
6,113,583 A 9/2000 Fowles et al.
6,117,114 A 9/2000 Paradis
D431,864 S 10/2000 Jansen
6,139,534 A 10/2000 Niedospial, Jr. et al.
6,142,446 A 11/2000 Leinsing
6,146,362 A 11/2000 Turnbull et al.
6,149,623 A 11/2000 Reynolds
6,156,025 A 12/2000 Niedospial, Jr. et al.
6,159,192 A 12/2000 Fowles et al.
6,168,037 B1 1/2001 Grimard
6,171,287 B1 1/2001 Lynn et al.
6,171,293 B1 1/2001 Rowley et al.
6,173,852 B1 1/2001 Browne
6,173,868 B1 1/2001 DeJonge
6,174,304 B1 1/2001 Weston
6,179,822 B1 1/2001 Niedospial, Jr.
6,179,823 B1 1/2001 Niedospial, Jr.
6,186,997 B1 2/2001 Gabbard et al.
6,206,861 B1 3/2001 Mayer
6,221,041 B1 4/2001 Russo
6,221,054 B1 4/2001 Martin et al.
6,221,065 B1 4/2001 Davis
6,238,372 B1 5/2001 Zinger et al.
6,245,044 B1 6/2001 Daw et al.
D445,501 S 7/2001 Niedospial, Jr.
D445,895 S 7/2001 Svendsen
6,253,804 B1 7/2001 Safabash
6,258,078 B1 7/2001 Thilly
6,280,430 B1 8/2001 Neftel et al.
6,290,688 B1 9/2001 Lopez et al.
6,296,621 B1 10/2001 Masuda et al.
6,299,131 B1 10/2001 Ryan
D453,472 S 2/2002 Kwong
6,343,629 B1 2/2002 Wessman et al.
6,348,044 B1 2/2002 Coletti et al.
6,358,236 B1 3/2002 DeFoggi et al.
6,364,866 B1 4/2002 Furr et al.
6,378,576 B2 4/2002 Thibault et al.
6,378,714 B1 4/2002 Jansen et al.
6,379,340 B1 4/2002 Zinger et al.
D457,954 S 5/2002 Wallace et al.
6,382,442 B1 5/2002 Thibault et al.
6,386,397 B2 5/2002 Brotspies et al.
6,408,897 B1 6/2002 Laurent et al.
6,409,708 B1 6/2002 Wessman
6,440,107 B1 8/2002 Trombley, III et al.
6,453,949 B1 9/2002 Chau
6,453,956 B2 9/2002 Safabash
6,474,375 B2 11/2002 Spero et al.
6,478,788 B1 11/2002 Aneas
D468,015 S 12/2002 Horppu
6,499,617 B1 12/2002 Niedospial, Jr. et al.
6,503,240 B1 1/2003 Niedospial, Jr. et al.
6,503,244 B2 1/2003 Hayman
6,520,932 B2 2/2003 Taylor
6,524,278 B1 2/2003 Campbell et al.
6,524,295 B2 2/2003 Daubert et al.
D472,316 S 3/2003 Douglas et al.
6,530,903 B2 3/2003 Wang et al.
6,537,263 B1 3/2003 Aneas
D472,630 S 4/2003 Douglas et al.
6,544,246 B1 4/2003 Niedospial, Jr.
6,551,299 B2 4/2003 Miyoshi et al.
6,558,365 B2 5/2003 Zinger et al.
D476,232 S 6/2003 Maus et al.
6,571,837 B2 6/2003 Jansen et al.
6,572,591 B2 6/2003 Mayer
6,575,955 B2 6/2003 Azzolini
6,581,593 B1 6/2003 Rubin et al.
6,582,415 B1 6/2003 Fowles et al.
D476,731 S 7/2003 Cise et al.
6,591,876 B2 7/2003 Safabash
6,599,273 B1 7/2003 Lopez
6,601,721 B2 8/2003 Jansen et al.
6,626,309 B1 9/2003 Jansen et al.
6,632,201 B1 10/2003 Mathias et al.
6,638,244 B1 10/2003 Reynolds
D482,121 S 11/2003 Harding et al.
D482,447 S 11/2003 Harding et al.
6,651,956 B2 11/2003 Miller
6,652,509 B1 11/2003 Helgren et al.
D483,487 S 12/2003 Harding et al.
D483,869 S 12/2003 Tran et al.
6,656,433 B2 12/2003 Sasso
6,666,852 B2 12/2003 Niedospial, Jr.
6,681,810 B2 1/2004 Weston
6,681,946 B1 1/2004 Jansen et al.
6,682,509 B2 1/2004 Lopez
6,692,478 B1 2/2004 Paradis
6,692,829 B2 2/2004 Stubler et al.
6,695,829 B2 2/2004 Hellstrom et al.
6,699,229 B2 3/2004 Zinger et al.
6,706,022 B1 3/2004 Leinsing et al.
6,706,031 B2 3/2004 Manera
6,715,520 B2 4/2004 Andreasson et al.
D490,315 S 5/2004 Kiser
6,729,370 B2 5/2004 Norton et al.
6,736,798 B2 5/2004 Ohkubo et al.
6,745,998 B2 6/2004 Doyle
6,746,438 B1 6/2004 Amissolle
6,752,180 B2 6/2004 Delay
D495,416 S 8/2004 Dimeo et al.
D496,457 S 9/2004 Prais et al.
6,802,490 B2 10/2004 Leinsing et al.
6,830,559 B2 * 12/2004 Schock ..... A61M 60/135
604/915
6,832,994 B2 12/2004 Niedospial, Jr. et al.
6,852,103 B2 2/2005 Fowles et al.
6,875,203 B1 4/2005 Fowles et al.
6,875,205 B2 4/2005 Leinsing
6,878,131 B2 4/2005 Novacek et al.
6,884,253 B1 4/2005 McFarlane
6,890,328 B2 5/2005 Fowles et al.
D506,256 S 6/2005 Miyoshi et al.
6,901,975 B2 6/2005 Aramata et al.
D508,202 S 8/2005 Dobson et al.
6,945,417 B2 9/2005 Jansen et al.
6,948,522 B2 9/2005 Newbrough et al.
6,949,086 B2 9/2005 Ferguson et al.
6,951,613 B2 10/2005 Reif et al.
6,957,745 B2 10/2005 Thibault et al.
6,960,164 B2 11/2005 D'Heeron
D513,180 S 12/2005 Lindsey et al.

(56) References Cited

U.S. PATENT DOCUMENTS 6,972,002 B2 12/2005 Thorne
6,979,318 B1 12/2005 McDonald et al.
RE38,996 E 2/2006 Crawford et al.
6,994,315 B2 2/2006 Ryan et al.
6,997,916 B2 2/2006 Simas, Jr. et al.
6,997,917 B2 2/2006 Niedospial, Jr. et al.
7,024,968 B2 4/2006 Raudabough et al.
7,070,589 B2 7/2006 Lolachi et al.
7,074,216 B2 7/2006 Fowles et al.
7,083,600 B2 8/2006 Meloul
7,086,431 B2 8/2006 D'Antonio et al.
7,097,637 B2 8/2006 Triplett et al.
7,100,890 B2 9/2006 Cote, Sr. et al.
7,140,401 B2 11/2006 Wilcox et al.
7,150,735 B2 12/2006 Hickle
7,192,423 B2 3/2007 Wong
7,195,623 B2 3/2007 Burroughs et al.
7,241,285 B1 7/2007 Dikeman
7,294,122 B2 11/2007 Kubo et al.
7,306,199 B2 12/2007 Leinsing et al.
D561,348 S 2/2008 Zinger et al.
7,326,188 B1 2/2008 Russell et al.
7,326,194 B2 2/2008 Zinger et al.
7,350,764 B2 4/2008 Raybuck
7,354,422 B2 4/2008 Riesenberger et al.
7,354,427 B2 4/2008 Fangrow
7,425,209 B2 9/2008 Fowles et al.
7,435,246 B2 10/2008 Zihlmann
D580,558 S 11/2008 Shigesada et al.
7,452,348 B2 11/2008 Hasegawa
D582,767 S 12/2008 Batton et al.
7,470,257 B2 12/2008 Norton et al.
7,470,265 B2 12/2008 Brugger et al.
7,472,932 B2 1/2009 Weber et al.
7,488,297 B2 2/2009 Flaherty
7,491,197 B2 2/2009 Jansen et al.
7,497,848 B2 3/2009 Leinsing et al.
7,523,967 B2 4/2009 Steppe
7,530,546 B2 5/2009 Ryan et al.
D595,420 S 6/2009 Suzuki et al.
D595,421 S 6/2009 Suzuki et al.
7,540,863 B2 6/2009 Haindl
7,540,865 B2 6/2009 Griffin et al.
7,544,191 B2 6/2009 Peluso et al.
D595,862 S 7/2009 Suzuki et al.
D595,863 S 7/2009 Suzuki et al.
D596,487 S 7/2009 Batton et al.
D604,612 S 11/2009 Germann
7,611,487 B2 11/2009 Woehr et al.
7,611,502 B2 11/2009 Daly
7,615,041 B2 11/2009 Sullivan et al.
D605,755 S 12/2009 Baxter et al.
7,628,779 B2 12/2009 Aneas
7,632,261 B2 12/2009 Zinger et al.
D608,900 S 1/2010 Giraud et al.
7,654,995 B2 2/2010 Warren et al.
7,670,326 B2 3/2010 Shemesh
7,695,445 B2 4/2010 Yuki
7,704,229 B2 4/2010 Moberg et al.
D616,090 S 5/2010 Kawamura
7,713,247 B2 5/2010 Lopez
7,717,886 B2 5/2010 Lopez
7,722,090 B2 5/2010 Burton et al.
D616,984 S 6/2010 Gilboa
7,731,678 B2 6/2010 Tennican et al.
7,743,799 B2 6/2010 Mosier et al.
7,744,581 B2 6/2010 Wallen et al.
7,757,901 B2 7/2010 Welp
7,758,082 B2 7/2010 Weigel et al.
7,758,560 B2 7/2010 Connell et al.
7,762,524 B2 7/2010 Cawthon et al.
7,766,304 B2 8/2010 Phillips
7,771,383 B2 8/2010 Truitt et al.
D624,641 S 9/2010 Boclet
7,799,009 B2 9/2010 Niedospial, Jr. et al.
7,803,140 B2 9/2010 Fangrow, Jr.
D624,820 S 10/2010 Sato
D627,216 S 11/2010 Fulginiti
D630,732 S 1/2011 Lev et al.
7,862,537 B2 1/2011 Zinger et al.
7,867,215 B2 1/2011 Akerlund et al.
7,879,018 B2 2/2011 Zinger et al.
7,883,499 B2 2/2011 Fangrow
7,895,216 B2 2/2011 Longshaw et al.
D634,007 S 3/2011 Zinger et al.
7,900,659 B2 3/2011 Whitley et al.
D637,713 S 5/2011 Nord et al.
7,963,954 B2 6/2011 Kavazov
D641,080 S 7/2011 Zinger et al.
7,985,216 B2 7/2011 Daily et al.
D644,104 S 8/2011 Maeda et al.
7,993,328 B2 8/2011 Whitley
8,007,461 B2 8/2011 Huo et al.
8,012,132 B2 9/2011 Lum et al.
8,016,809 B2 9/2011 Zinger et al.
8,021,325 B2 9/2011 Zinger et al.
8,025,653 B2 9/2011 Capitaine et al.
8,025,683 B2 9/2011 Morrison
8,029,472 B2 10/2011 Leinsing et al.
8,038,123 B2 10/2011 Ruschke et al.
8,066,688 B2 11/2011 Zinger et al.
8,070,739 B2 12/2011 Zinger et al.
8,075,550 B2 12/2011 Nord et al.
8,096,525 B2 1/2012 Ryan
8,105,314 B2 1/2012 Fangrow, Jr.
D654,166 S 2/2012 Lair
D655,017 S 2/2012 Mosler et al.
8,122,923 B2 2/2012 Kraus et al.
8,123,736 B2 2/2012 Kraushaar et al.
D655,071 S 3/2012 Davila
D657,461 S 4/2012 Schembre et al.
8,152,779 B2 4/2012 Cabiri
8,157,784 B2 4/2012 Rogers
8,167,863 B2 5/2012 Yow
8,172,824 B2 5/2012 Pfeifer et al.
8,177,768 B2 5/2012 Leinsing
8,182,452 B2 5/2012 Mansour et al.
8,187,248 B2 5/2012 Zihlmann
8,196,614 B2 6/2012 Kriheli
8,197,459 B2 6/2012 Jansen et al.
8,211,069 B2 7/2012 Fangrow, Jr.
8,225,959 B2 7/2012 Lambrecht
8,241,268 B2 8/2012 Whitley
8,262,628 B2 9/2012 Fangrow, Jr.
8,262,641 B2 9/2012 Vedrine et al.
8,267,127 B2 9/2012 Kriheli
D669,579 S 10/2012 Marshall et al.
D669,980 S 10/2012 Lev et al.
8,287,513 B2 10/2012 Ellstrom et al.
8,328,784 B2 12/2012 Jensen et al.
D673,673 S 1/2013 Wang
D674,084 S 1/2013 Linnenschmidt
D674,088 S 1/2013 Lev et al.
8,348,898 B2 1/2013 Cabiri
D681,230 S 4/2013 Mosier et al.
8,454,573 B2 6/2013 Wyatt et al.
8,469,939 B2 6/2013 Fangrow, Jr.
8,475,404 B2 7/2013 Foshee et al.
8,480,645 B1 7/2013 Choudhury et al.
8,480,646 B2 7/2013 Nord et al.
8,506,548 B2 8/2013 Okiyama
8,511,352 B2 8/2013 Kraus et al.
8,512,309 B2 8/2013 Shemesh et al.
D690,009 S 9/2013 Schembre et al.
D690,418 S 9/2013 Rosenquist
8,523,837 B2 9/2013 Wiggins et al.
8,545,476 B2 10/2013 Ariagno et al.
8,551,067 B2 10/2013 Zinger et al.
8,556,879 B2 10/2013 Okiyama
8,562,582 B2 10/2013 Tuckwell et al.
8,608,723 B2 12/2013 Lev et al.
8,628,508 B2 1/2014 Weitzel et al.
8,636,689 B2 1/2014 Halili, Jr. et al.
8,684,992 B2 4/2014 Sullivan et al.

(56) References Cited

U.S. PATENT DOCUMENTS 8,684,994 B2 4/2014 Lev et al.
8,752,598 B2 6/2014 Denenburg et al.
D714,935 S 10/2014 Nishioka et al.
D717,406 S 11/2014 Stanley et al.
D717,948 S 11/2014 Strong et al.
D719,650 S 12/2014 Arinobe et al.
D720,067 S 12/2014 Rosenquist
D720,451 S 12/2014 Denenburg et al.
D720,452 S 12/2014 Jordan
8,900,212 B2 12/2014 Kubo
8,905,994 B1 12/2014 Lev et al.
8,915,882 B2 12/2014 Cabiri
D720,850 S 1/2015 Hsia et al.
D732,660 S 6/2015 Ohashi
D732,664 S 6/2015 Woehr et al.
D733,291 S 6/2015 Wang
D733,292 S 6/2015 Rogers
D733,293 S 6/2015 Rogers
9,072,827 B2 7/2015 Cabiri
9,089,475 B2 7/2015 Fangrow
D738,494 S 9/2015 Kashmirian
D741,457 S 10/2015 Guest
9,149,575 B2 10/2015 Cabiri
D747,471 S 1/2016 Gulliver et al.
D750,235 S 2/2016 Maurice
9,254,242 B2 2/2016 Mueller et al.
D757,933 S 5/2016 Lev et al.
9,339,438 B2 5/2016 Lev et al.
9,393,365 B2 7/2016 Cabiri
9,414,991 B2 8/2016 Sanders et al.
9,486,391 B2 11/2016 Shemesh
9,492,610 B2 11/2016 Cabiri
9,511,190 B2 12/2016 Cabiri
9,522,234 B2 12/2016 Cabiri
D794,183 S 8/2017 Lev et al.
9,763,855 B2 9/2017 Fangrow
9,801,786 B2 10/2017 Lev et al.
D831,198 S 10/2018 Ross et al.
D831,201 S 10/2018 Holtz et al.
D832,430 S 10/2018 Denenburg et al.
D834,187 S 11/2018 Ryan
10,206,854 B2 2/2019 Wu et al.
D847,589 S 5/2019 Habig et al.
10,376,654 B2 8/2019 Sanders et al.
10,688,295 B2 6/2020 Lev et al.
2001/0000347 A1 4/2001 Hellstrom et al.
2001/0025671 A1 10/2001 Safabash
2001/0029360 A1 10/2001 Miyoshi et al.
2001/0051793 A1 12/2001 Weston
2002/0017328 A1 2/2002 Loo
2002/0055711 A1 5/2002 Lavi et al.
2002/0065488 A1 5/2002 Suzuki et al.
2002/0066715 A1 6/2002 Niedospial
2002/0087118 A1 7/2002 Reynolds et al.
2002/0087141 A1 7/2002 Zinger et al.
2002/0087144 A1 7/2002 Zinger et al.
2002/0104584 A1 8/2002 Spero et al.
2002/0115980 A1 8/2002 Niedospial et al.
2002/0121496 A1 9/2002 Thiebault et al.
2002/0123736 A1 9/2002 Fowles et al.
2002/0127150 A1 9/2002 Sasso
2002/0128628 A1 9/2002 Fathallah
2002/0138045 A1 9/2002 Moen
2002/0173752 A1 11/2002 Polzin
2002/0193777 A1 12/2002 Aneas
2003/0028156 A1 2/2003 Juliar
2003/0036725 A1 2/2003 Lavi et al.
2003/0068354 A1 4/2003 Reif et al.
2003/0069550 A1 4/2003 Sharp
2003/0073971 A1 4/2003 Saker
2003/0100866 A1 5/2003 Reynolds
2003/0109846 A1 6/2003 Zinger et al.
2003/0120209 A1 6/2003 Jensen et al.
2003/0135159 A1 7/2003 Daily et al.
2003/0153895 A1 8/2003 Leinsing
2003/0187420 A1 10/2003 Akerlund et al.
2003/0191445 A1 10/2003 Wallen et al.
2003/0195479 A1 10/2003 Kuracina et al.
2003/0199827 A1 10/2003 Thorne
2003/0199846 A1 10/2003 Fowles et al.
2003/0199847 A1 10/2003 Akerlund et al.
2003/0205843 A1 11/2003 Adams
2003/0236543 A1 12/2003 Brenneman et al.
2004/0010207 A1 1/2004 Flaherty et al.
2004/0024354 A1 2/2004 Reynolds
2004/0039365 A1 2/2004 Aramata et al.
2004/0044327 A1 3/2004 Hasegawa
2004/0073189 A1 4/2004 Wyatt et al.
2004/0143218 A1 7/2004 Das
2004/0143226 A1 7/2004 Marsden
2004/0153047 A1 8/2004 Blank et al.
2004/0158172 A1 8/2004 Hancock
2004/0162540 A1 8/2004 Walenciak et al.
2004/0167472 A1 8/2004 Howell et al.
2004/0181192 A1 9/2004 Cuppy
2004/0186424 A1 9/2004 Hjertman
2004/0199139 A1 10/2004 Fowles et al.
2004/0204699 A1 10/2004 Hanly et al.
2004/0217315 A1 11/2004 Doyle
2004/0225274 A1 11/2004 Jansen et al.
2004/0236305 A1 11/2004 Jansen et al.
2004/0249341 A1 12/2004 Newbrough et al.
2004/0255952 A1 12/2004 Carlsen et al.
2005/0015070 A1 1/2005 Delnevo et al.
2005/0016626 A1 1/2005 Wilcox et al.
2005/0049553 A1 3/2005 Triplett et al.
2005/0055008 A1 3/2005 Paradis et al.
2005/0082828 A1 4/2005 Wicks et al.
2005/0124964 A1 6/2005 Niedospial et al.
2005/0137523 A1 6/2005 Wyatt et al.
2005/0137566 A1 6/2005 Fowles et al.
2005/0148994 A1 7/2005 Leinsing
2005/0159706 A1 7/2005 Wilkinson et al.
2005/0159724 A1 7/2005 Enerson
2005/0182383 A1 8/2005 Wallen
2005/0209554 A1 9/2005 Landau
2005/0261637 A1 11/2005 Miller
2005/0277896 A1 12/2005 Messerli et al.
2006/0030832 A1 2/2006 Niedospial et al.
2006/0079834 A1 4/2006 Tennican et al.
2006/0089594 A1 4/2006 Landau
2006/0089603 A1 4/2006 Truitt et al.
2006/0095015 A1 5/2006 Hobbs et al.
2006/0106360 A1 5/2006 Wong
2006/0135948 A1 6/2006 Varma
2006/0155257 A1 7/2006 Reynolds
2006/0161192 A1 7/2006 Young
2006/0173410 A1 8/2006 Moberg et al.
2006/0178646 A1 8/2006 Harris et al.
2006/0195029 A1 8/2006 Shults et al.
2006/0212004 A1 9/2006 Atil
2006/0253084 A1 11/2006 Nordgren
2006/0259004 A1 11/2006 Connell et al.
2007/0016381 A1 1/2007 Kamath et al.
2007/0024995 A1 2/2007 Hayashi
2007/0060904 A1 3/2007 Vedrine et al.
2007/0078428 A1 4/2007 Reynolds et al.
2007/0079894 A1 4/2007 Kraus et al.
2007/0083164 A1 4/2007 Barrelle et al.
2007/0088252 A1 4/2007 Pestotnik et al.
2007/0088293 A1 4/2007 Fangrow
2007/0088313 A1 4/2007 Zinger et al.
2007/0106218 A1 5/2007 Yodfat et al.
2007/0106244 A1 5/2007 Mosler et al.
2007/0112324 A1 5/2007 Hamedi-Sangsari
2007/0156112 A1 7/2007 Walsh
2007/0167904 A1 7/2007 Zinger et al.
2007/0167912 A1 7/2007 Causey et al.
2007/0191760 A1 8/2007 Iguchi et al.
2007/0191764 A1 8/2007 Zihlmann
2007/0191767 A1 8/2007 Hennessy et al.
2007/0203451 A1 8/2007 Murakami et al.
2007/0219483 A1 9/2007 Kitani et al.
2007/0244447 A1 10/2007 Capitaine et al.

(56) References Cited

U.S. PATENT DOCUMENTS

2007/0244461 A1 10/2007 Fangrow
2007/0244462 A1 10/2007 Fangrow
2007/0244463 A1 10/2007 Warren et al.
2007/0249995 A1 10/2007 Van Manen
2007/0255202 A1 11/2007 Kitani et al.
2007/0265574 A1 11/2007 Tennican et al.
2007/0265581 A1 11/2007 Funamura et al.
2007/0270778 A9 11/2007 Zinger et al.
2007/0287953 A1 12/2007 Ziv et al.
2007/0299404 A1 12/2007 Katoh et al.
2008/0009789 A1 1/2008 Zinger et al.
2008/0009822 A1 1/2008 Enerson
2008/0015496 A1 1/2008 Hamedi-Sangsari
2008/0132851 A1 6/2008 Shaw et al.
2008/0135051 A1 6/2008 Lee
2008/0172024 A1 7/2008 Yow
2008/0188799 A1 8/2008 Mueller-Beckhaus et al.
2008/0195049 A1 8/2008 Thalmann et al.
2008/0208138 A1 8/2008 Lim et al.
2008/0215015 A1 9/2008 Cindrich et al.
2008/0249473 A1 10/2008 Rutti et al.
2008/0249479 A1 10/2008 Zinger et al.
2008/0249498 A1 10/2008 Fangrow
2008/0262465 A1 10/2008 Zinger et al.
2008/0269687 A1 10/2008 Chong et al.
2008/0275407 A1 11/2008 Scheurer
2008/0287905 A1 11/2008 Hiejima et al.
2008/0294100 A1 11/2008 de Costa et al.
2008/0306439 A1 12/2008 Nelson et al.
2008/0312634 A1 12/2008 Helmerson et al.
2009/0012492 A1 1/2009 Zihlmann
2009/0043253 A1 2/2009 Podaima
2009/0054834 A1 2/2009 Zinger et al.
2009/0054852 A1 2/2009 Takano et al.
2009/0062767 A1 3/2009 Van Antwerp et al.
2009/0076360 A1 3/2009 Brister et al.
2009/0082750 A1 3/2009 Denenburg et al.
2009/0139724 A1 6/2009 Gray et al.
2009/0143758 A1 6/2009 Okiyama
2009/0177177 A1 7/2009 Zinger et al.
2009/0177178 A1 7/2009 Pedersen
2009/0187140 A1 7/2009 Racz
2009/0216103 A1 8/2009 Brister et al.
2009/0216212 A1 8/2009 Fangrow, Jr.
2009/0267011 A1 10/2009 Hatton et al.
2009/0299325 A1 12/2009 Vedrine et al.
2009/0318946 A1 12/2009 Tamesada
2009/0326506 A1 12/2009 Hasegawa et al.
2010/0010443 A1 1/2010 Morgan et al.
2010/0016811 A1 1/2010 Smith
2010/0022985 A1 1/2010 Sullivan et al.
2010/0030181 A1 2/2010 Helle et al.
2010/0036319 A1 2/2010 Drake et al.
2010/0076397 A1 3/2010 Reed et al.
2010/0087786 A1 4/2010 Zinger et al.
2010/0137827 A1 6/2010 Warren et al.
2010/0137831 A1 6/2010 Tsais
2010/0152658 A1 6/2010 Hanson et al.
2010/0160889 A1 6/2010 Smith et al.
2010/0162548 A1 7/2010 Leidig
2010/0168664 A1 7/2010 Zinger et al.
2010/0168712 A1 7/2010 Tuckwell et al.
2010/0179506 A1 7/2010 Shemesh et al.
2010/0198148 A1 8/2010 Zinger et al.
2010/0204670 A1 8/2010 Kraushaar et al.
2010/0228220 A1 9/2010 Zinger et al.
2010/0241088 A1 9/2010 Ranalletta et al.
2010/0274184 A1 10/2010 Chun
2010/0274202 A1 10/2010 Hyde et al.
2010/0286661 A1 11/2010 Raday et al.
2010/0312220 A1 12/2010 Kalitzki
2011/0004143 A1 1/2011 Beiriger et al.
2011/0004184 A1 1/2011 Proksch et al.
2011/0044850 A1 2/2011 Solomon et al.
2011/0054440 A1 3/2011 Lewis
2011/0087164 A1 4/2011 Mosler et al.
2011/0125056 A1 5/2011 Merchant
2011/0144584 A1 6/2011 Wozencroft
2011/0160655 A1 6/2011 Hanson et al.
2011/0160701 A1 6/2011 Wyatt et al.
2011/0172636 A1 7/2011 Aasmul
2011/0175347 A1 7/2011 Okiyama
2011/0218511 A1 9/2011 Yokoyama
2011/0224640 A1 9/2011 Kuhn et al.
2011/0230856 A1 9/2011 Kyle et al.
2011/0264037 A1 10/2011 Foshee et al.
2011/0264069 A1 10/2011 Bochenko
2011/0276007 A1 11/2011 Denenburg
2011/0319827 A1 12/2011 Leinsing et al.
2012/0022344 A1 1/2012 Kube
2012/0022469 A1 1/2012 Alpert
2012/0053555 A1 3/2012 Ariagno et al.
2012/0059332 A1 3/2012 Woehr et al.
2012/0059346 A1 3/2012 Sheppard et al.
2012/0067429 A1 3/2012 Mosler et al.
2012/0071819 A1 3/2012 Bruggemann et al.
2012/0078214 A1 3/2012 Finke et al.
2012/0123382 A1 5/2012 Kubo
2012/0184938 A1 7/2012 Lev et al.
2012/0215182 A1 8/2012 Mansour et al.
2012/0220977 A1 8/2012 Yow
2012/0220978 A1 8/2012 Lev et al.
2012/0265163 A1 10/2012 Cheng et al.
2012/0271229 A1 10/2012 Lev et al.
2012/0296307 A1 11/2012 Holt et al.
2012/0310203 A1 12/2012 Khaled et al.
2012/0323172 A1 12/2012 Lev et al.
2012/0323187 A1 12/2012 Iwase et al.
2012/0323210 A1 12/2012 Lev et al.
2013/0046269 A1 2/2013 Lev et al.
2013/0053814 A1 2/2013 Mueller-Beckhaus et al.
2013/0096493 A1 4/2013 Kubo et al.
2013/0110049 A1 5/2013 Cronenberg et al.
2013/0144248 A1 6/2013 Putter et al.
2013/0199669 A1 8/2013 Moy et al.
2013/0226100 A1 8/2013 Lev
2013/0231630 A1 9/2013 Kraus et al.
2013/0237904 A1 9/2013 Deneburg et al.
2013/0253448 A1 9/2013 Baron et al.
2013/0289530 A1 10/2013 Wyatt et al.
2014/0020793 A1 1/2014 Denenburg et al.
2014/0096862 A1 4/2014 Aneas
2014/0150911 A1 6/2014 Hanner et al.
2014/0194854 A1 7/2014 Tsais
2014/0221940 A1 8/2014 Clauson et al.
2014/0277052 A1 9/2014 Haselby et al.
2014/0352845 A1 12/2014 Lev et al.
2015/0082746 A1 3/2015 Ivosevic et al.
2015/0088078 A1 3/2015 Lev et al.
2015/0112297 A1 4/2015 Lev et al.
2015/0209230 A1 7/2015 Lev et al.
2015/0209232 A1 7/2015 Haindl
2015/0209568 A1* 7/2015 Rosenquist ..... A61M 39/16 285/45
2015/0231034 A1 8/2015 Lev et al.
2015/0290390 A1 10/2015 Ring et al.
2015/0297839 A1 10/2015 Sanders et al.
2015/0305770 A1 10/2015 Fill et al.
2016/0051446 A1 2/2016 Lev et al.
2016/0088995 A1 3/2016 Ueda et al.
2016/0166824 A1 6/2016 Lev et al.
2016/0199569 A1 7/2016 Yevmenenko et al.
2016/0228644 A1 8/2016 Cabiri
2016/0287475 A1 10/2016 Yevmenenko et al.
2016/0367439 A1 12/2016 Davis et al.
2017/0333286 A1* 11/2017 Phipps ..... A61J 1/2013
2018/0325775 A1 11/2018 David et al.
2019/0133885 A1 5/2019 Wu et al.
2019/0282795 A1 9/2019 Fangrow

FOREIGN PATENT DOCUMENTS

CN 1747683 A 3/2006
CN 1863566 A 11/2006

(56) References Cited

FOREIGN PATENT DOCUMENTS

| | | | |
|---|---|---|---|
| CN | 1950049 | A | 4/2007 |
| CN | 101001661 | A | 7/2007 |
| CN | 101342963 | A | 1/2009 |
| CN | 101687083 | A | 3/2010 |
| CN | 102711712 | A | 10/2012 |
| CN | 104703574 | A | 6/2015 |
| CN | 104884028 | A | 9/2015 |
| DE | 1064693 | B | 9/1959 |
| DE | 1913926 | A1 | 9/1970 |
| DE | 4112476 | A1 | 12/1991 |
| DE | 4122476 | A1 | 1/1993 |
| DE | 4408498 | A1 | 5/1995 |
| DE | 19504413 | A1 | 8/1996 |
| DE | 202004012714 | U1 | 11/2004 |
| DE | 102007046951 | B3 | 2/2009 |
| DE | 202009011019 | U1 | 12/2010 |
| EM | 300627237-0001 | | 1/2007 |
| EM | 001680703-0002 | A1 | 3/2010 |
| EP | 0089851 | A2 | 9/1983 |
| EP | 0192661 | A1 | 9/1986 |
| EP | 0195018 | A1 | 9/1986 |
| EP | 0912661 | A1 | 9/1986 |
| EP | 0258913 | A2 | 3/1988 |
| EP | 0416454 | A2 | 3/1991 |
| EP | 0426403 | A1 | 5/1991 |
| EP | 0282545 | B1 | 2/1992 |
| EP | 0518397 | A1 | 12/1992 |
| EP | 0521460 | A1 | 1/1993 |
| EP | 582038 | A2 | 2/1994 |
| EP | 0598918 | A1 | 6/1994 |
| EP | 0637443 | A1 | 2/1995 |
| EP | 0737467 | A1 | 10/1996 |
| EP | 761562 | A1 | 3/1997 |
| EP | 765652 | A1 | 4/1997 |
| EP | 765853 | A1 | 4/1997 |
| EP | 0806597 | A1 | 11/1997 |
| EP | 0814866 | A1 | 1/1998 |
| EP | 829248 | A2 | 3/1998 |
| EP | 0856331 | A2 | 8/1998 |
| EP | 882441 | A2 | 12/1998 |
| EP | 0887085 | A2 | 12/1998 |
| EP | 0887885 | A2 | 12/1998 |
| EP | 897708 | A2 | 2/1999 |
| EP | 0898951 | A2 | 3/1999 |
| EP | 0904763 | A2 | 3/1999 |
| EP | 960616 | A2 | 12/1999 |
| EP | 1008337 | A1 | 6/2000 |
| EP | 1029526 | A1 | 8/2000 |
| EP | 1034809 | A1 | 9/2000 |
| EP | 1051988 | A2 | 11/2000 |
| EP | 1323403 | A1 | 7/2003 |
| EP | 1329210 | A1 | 7/2003 |
| EP | 1396250 | A1 | 3/2004 |
| EP | 1454609 | A1 | 9/2004 |
| EP | 1454650 | A1 | 9/2004 |
| EP | 1498097 | A2 | 1/2005 |
| EP | 1872824 | A1 | 1/2008 |
| EP | 1911432 | A1 | 4/2008 |
| EP | 1919432 | A1 | 5/2008 |
| EP | 1930038 | A2 | 6/2008 |
| EP | 2090278 | A1 | 8/2009 |
| EP | 2351548 | A1 | 8/2011 |
| EP | 2351549 | A1 | 8/2011 |
| EP | 2462913 | A1 | 6/2012 |
| EP | 2512399 | A1 | 10/2012 |
| FR | 2029242 | A5 | 10/1970 |
| FR | 2856660 | A1 | 12/2004 |
| FR | 2869795 | A1 | 11/2005 |
| FR | 2931363 | A1 | 11/2009 |
| GB | 1444210 | A | 7/1976 |
| IL | 171662 | | 10/2005 |
| IL | 186290 | | 1/2008 |
| IL | 245800 | * | 8/2016 |
| JP | 03-062426 | B | 9/1991 |
| JP | 03-205560 | A | 9/1991 |
| JP | 04-329954 | A | 11/1992 |
| JP | 06-050656 | U | 7/1994 |
| JP | 08-000170 | A | 1/1996 |
| JP | H08-000710 | A | 1/1996 |
| JP | 09-104460 | A | 4/1997 |
| JP | 09-104461 | A | 4/1997 |
| JP | 10-118158 | | 5/1998 |
| JP | H10-504736 | A | 5/1998 |
| JP | H11503627 | A | 3/1999 |
| JP | H11-512309 | A | 10/1999 |
| JP | 11-319031 | A | 11/1999 |
| JP | 2000-508934 | A | 7/2000 |
| JP | 2000-237278 | A | 9/2000 |
| JP | 2000262497 | A | 9/2000 |
| JP | 2001-505083 | A | 4/2001 |
| JP | 2002-035140 | A | 2/2002 |
| JP | 2002-516160 | A | 6/2002 |
| JP | 2002-355318 | A | 12/2002 |
| JP | 2003-033441 | A | 2/2003 |
| JP | 2003-102807 | A | 4/2003 |
| JP | 2003-513709 | A | 4/2003 |
| JP | 2004-501721 | A | 1/2004 |
| JP | 2004-097253 | A | 4/2004 |
| JP | 2004-522541 | A | 7/2004 |
| JP | 2005-270629 | A | 10/2005 |
| JP | 200661421 | A | 3/2006 |
| JP | 2008-220961 | A | 9/2008 |
| JP | 4329954 | B2 | 9/2009 |
| JP | 2010063622 | A | 3/2010 |
| JP | 2010-179128 | A | 8/2010 |
| JP | 2012-205769 | A | 10/2012 |
| JP | 2014000220 | A | 1/2014 |
| JP | 2016-515439 | A | 5/2016 |
| JP | 3205560 | U | 8/2016 |
| WO | 8601712 | A1 | 3/1986 |
| WO | 8605683 | A1 | 10/1986 |
| WO | 9003536 | A1 | 4/1990 |
| WO | 9403373 | A1 | 2/1994 |
| WO | 9507066 | A1 | 3/1995 |
| WO | 9513785 | A1 | 5/1995 |
| WO | 9600053 | A1 | 1/1996 |
| WO | 9609083 | A1 | 3/1996 |
| WO | 9629113 | A1 | 9/1996 |
| WO | 9736636 | A1 | 10/1997 |
| WO | 9832411 | A1 | 7/1998 |
| WO | 9837854 | A1 | 9/1998 |
| WO | 9961093 | A1 | 12/1999 |
| WO | 01/29526 | A1 | 4/2001 |
| WO | 0128490 | A1 | 4/2001 |
| WO | 01/32542 | A1 | 5/2001 |
| WO | 0130425 | A1 | 5/2001 |
| WO | 0134089 | A1 | 5/2001 |
| WO | 9132524 | A1 | 5/2001 |
| WO | 0160311 | A1 | 8/2001 |
| WO | 0189607 | A2 | 11/2001 |
| WO | 0191693 | A2 | 12/2001 |
| WO | 02/06610 | A1 | 1/2002 |
| WO | 0202165 | A2 | 1/2002 |
| WO | 200209797 | A1 | 2/2002 |
| WO | 0232372 | A1 | 4/2002 |
| WO | 0236191 | A2 | 5/2002 |
| WO | 02066100 | A2 | 8/2002 |
| WO | 02089900 | A1 | 11/2002 |
| WO | 03051423 | A2 | 6/2003 |
| WO | 03070147 | A2 | 8/2003 |
| WO | 03079956 | A1 | 10/2003 |
| WO | 2004041148 | A1 | 5/2004 |
| WO | 2004096113 | A2 | 11/2004 |
| WO | 2005002492 | A1 | 1/2005 |
| WO | 2005018703 | A2 | 3/2005 |
| WO | 2005041846 | A2 | 5/2005 |
| WO | 2005105014 | A2 | 11/2005 |
| WO | 2006/085327 | A1 | 8/2006 |
| WO | 2006099441 | A2 | 9/2006 |
| WO | 2007015233 | A1 | 2/2007 |
| WO | 2007017868 | A1 | 2/2007 |
| WO | 2007052252 | A1 | 5/2007 |
| WO | 2007/105221 | A1 | 9/2007 |
| WO | 2007101772 | A1 | 9/2007 |

(56) References Cited

FOREIGN PATENT DOCUMENTS

| | | | |
|---|---|---|---|
| WO | 2008076459 | A1 | 6/2008 |
| WO | 2008081424 | A2 | 7/2008 |
| WO | 2008126090 | A1 | 10/2008 |
| WO | 2009026443 | A2 | 2/2009 |
| WO | 2009029010 | A1 | 3/2009 |
| WO | 2009038860 | A2 | 3/2009 |
| WO | 2009040804 | A2 | 4/2009 |
| WO | 2009087572 | A1 | 7/2009 |
| WO | 2009093249 | A1 | 7/2009 |
| WO | 2009112489 | A1 | 9/2009 |
| WO | 2009146088 | A1 | 12/2009 |
| WO | 2010061743 | A1 | 6/2010 |
| WO | 2010078227 | A1 | 7/2010 |
| WO | 2010117580 | A1 | 10/2010 |
| WO | 2011/004360 | A1 | 1/2011 |
| WO | 2011039747 | A1 | 4/2011 |
| WO | 2011058545 | A1 | 5/2011 |
| WO | 2011058548 | A1 | 5/2011 |
| WO | 2011077434 | A1 | 6/2011 |
| WO | 2011090955 | A1 | 7/2011 |
| WO | 2011104711 | A1 | 9/2011 |
| WO | 2011156373 | A1 | 12/2011 |
| WO | 2012/004790 | A2 | 1/2012 |
| WO | 2012004784 | A1 | 1/2012 |
| WO | 2012/043921 | A1 | 4/2012 |
| WO | 2012063230 | A1 | 5/2012 |
| WO | 2012143921 | A1 | 10/2012 |
| WO | 2012150587 | A1 | 11/2012 |
| WO | 2013127813 | A1 | 9/2013 |
| WO | 2013134246 | A1 | 9/2013 |
| WO | 2013148435 | A1 | 10/2013 |
| WO | 2013156944 | A1 | 10/2013 |
| WO | 2013156994 | A1 | 10/2013 |
| WO | 2014033706 | A2 | 3/2014 |
| WO | 2014033710 | A1 | 3/2014 |
| WO | 2014099395 | A1 | 6/2014 |
| WO | 2014170888 | A1 | 10/2014 |
| WO | 2014174278 | A1 | 10/2014 |
| WO | 2015019343 | A1 | 2/2015 |
| WO | 2016023590 | A1 | 2/2016 |
| WO | 2016110838 | A1 | 7/2016 |

OTHER PUBLICATIONS

Int'l Preliminary Report on Patentability dated Aug. 24, 2015 in Int'l Application No. PCT/IL2014/050405.
Int'l Preliminary Report on Patentability dated Feb. 12, 2016 in Int'l Application No. PCT/IL2016/050002.
Int'l Preliminary Report on Patentability dated Feb. 13, 2018 in Int'l Application No. PCT/IL2016/051265.
Int'l Preliminary Report on Patentability dated Feb. 26, 2019 in Int'l Application No. PCT/ IL2017/051308.
Int'l Preliminary Report on Patentability dated Jul. 25, 2018 in Int'l Application No. PCT/IL2017/050527.
Int'l Preliminary Report on Patentability dated Jun. 5, 2018 in Int'l Application No. PCT/IL2017/050514.
Int'l Preliminary Report on Patentability dated Nov. 26, 2018 in Int'l Application No. PCT/IL2017/051299.
Int'l Search Report and Written Opinion dated Feb. 16, 2018 in Int'l Application No. PCT/IL2017/051299.
Int'l Search Report and Written opinion dated Jun. 13, 2018 in Int'l Application No. PCT/IL2018/050336.
Int'l Search Report and Written Opinion dated Nov. 8, 2017 in Int'l Application No. PCT/IL2017/050903.
Int'l Search Report and Written Opinion dated Oct. 11, 2016 in Int'l Application No. PCT/IL2016/050782.
Int'l Search Report and Written Opinion dated Sep. 14, 2016 in Int'l Application No. PCT/IL2016/050709.
Int'l Search Report and Written Opinion dated Sep. 5, 2017 in Int'l Application No. PCT/IL2017/050624.
Int'l Search Report and Written Opinion dated Sep. 8, 2017 in Int'l Application No. PCT/IL2017/050527.
Int'l Search Report dated Apr. 20, 2016 in Int'l Application No. PCT/IL2016/050002.
Int'l Search Report dated Aug. 25, 2008 in Int'l Application No. PCT/IL2008/000517.
Int'l Search Report dated Jan. 22, 2013 in Int'l Application No. PCT/IL2012/000354.
Int'l Search Report dated Nov. 20, 2006 in Int'l Application No. PCT/IL2006/000881.
International Search Report and Written Opinion dated Oct. 17, 2014 in International Application No. PCT/IL2014/050680.
International Search Report dated Jan. 23, 2007 in Int'l Application No. PCT/IL/2006/001228.
Intl Search Report dated Dec. 6, 2006 in Int'l Application No. PCT/IL2006/000912.
Notice of Allowance dated Jan. 12, 2016 in U.S. Appl. No. 14/385,212 by Lev.
Notice of Allowance dated Mar. 17, 2016 in U.S. Appl. No. 29/502,037 by Lev.
Office Action dated Apr. 17, 2014 in CN Application No. 201080051201.4.
Office Action dated Apr. 2, 2013 in U.S. Appl. No. 13/505,790.
Office Action dated Apr. 20, 2010 in U.S. Appl. No. 11/997,569.
Office Action dated Apr. 9, 2015 in U.S. Appl. No. 13/883,289 by Lev.
Office Action dated Aug. 2, 2017 in CN Application No. 201480026311.3.
Office Action dated Aug. 20, 2013 in U.S. Appl. No. 13/576,461 by Lev.
Office Action dated Aug. 24, 2015 in U.S. Appl. No. 14/366,306 by Lev.
Office Action dated Aug. 3, 2011 in JP Application No. 2008-525719.
Office Action dated Aug. 7, 2015 in JP Application No. 2015-529206.
Office Action dated Dec. 13, 2010 in U.S. Appl. No. 12/293,122.
Office Action dated Dec. 20, 2010 in U.S. Appl. No. 12/063,176.
Office Action dated Dec. 21, 2016 in IL Application No. 228452.
Office Action dated Dec. 23, 2010 in U.S. Appl. No. 29/334,696.
Office Action dated Dec. 9, 2015 in U.S. Appl. No. 29/478,723 by Lev.
Office Action dated Dec. 9, 2015 in U.S. Appl. No. 29/478,726 by Lev.
Office Action dated Feb. 13, 2014 in U.S. Appl. No. 13/884,981 by Denenburg.
Office Action dated Feb. 20, 2009 in U.S. Appl. No. 11/694,297.
Office Action dated Feb. 22, 2005 in U.S. Appl. No. 10/062,796.
Office Action dated Feb. 7, 2011 in U.S. Appl. No. 12/783,194.
Office Action dated Jan. 17, 2014 in CN Application No. 201180006534.X.
Office Action dated Jan. 2, 2014 in U.S. Appl. No. 13/505,881 by Lev.
Office Action dated Jan. 2, 2015 in U.S. Appl. No. 29/438,141 by Gilboa.
Office Action dated Jan. 20, 2010 in JP Application No. 2007-510229.
Office Action dated Jan. 23, 2013 in U.S. Appl. No. 12/112,490 by Zinger.
Office Action dated Jan. 5, 2015 in U.S. Appl. No. 29/413,220 by Lev.
Office Action dated Jul. 11, 2011 in U.S. Appl. No. 12/293,122.
Office Action dated Jul. 13, 2012 in U.S. Appl. No. 12/112,490 by Zinger.
Office Action dated Jul. 31, 2014 in U.S. Appl. No. 29/438,141 by Gilboa.
Office Action dated Jun. 1, 2010 in U.S. Appl. No. 11/568,421.
Office Action dated Jun. 14, 2012 in U.S. Appl. No. 29/376,980.
Office Action dated Jun. 15, 2011 in JP Application No. 2008-538492.
Office Action dated Jun. 15, 2012 in U.S. Appl. No. 29/413,170.
Office Action dated Jun. 21, 2012 in U.S. Appl. No. 12/596,167.
Office Action dated Jun. 26, 2017 in U.S. Appl. No. 14/423,595, by Lev.

(56) References Cited

OTHER PUBLICATIONS

Office Action dated Jun. 8, 2010 in U.S. Appl. No. 12/112,490 by Zinger.
Office Action dated Mar. 10, 2015 in EP Application No. 12 812 395.7.
Office Action dated Mar. 13, 2012 in CA Application No. 2,563,643.
Office Action dated Mar. 17, 2015 in U.S. Appl. No. 14/504,979 by Lev.
Office Action dated Mar. 25, 2016 in U.S. Appl. No. 29/478,726 by Lev.
Office Action dated Mar. 28, 2016 in JP Application No. 2016-507113.
Office Action dated Mar. 6, 2012 in U.S. Appl. No. 12/678,928.
Office Action dated May 12, 2011 in U.S. Appl. No. 12/063,176.
Office Action dated May 27, 2010 in U.S. Appl. No. 11/559,152.
Office Action dated May 28, 2015 in U.S. Appl. No. 14/391,792 by Lev.
Office Action dated May 31, 2013 in U.S. Appl. No. 13/505,790.
Office Action dated May 6, 2014 in U.S. Appl. No. 13/505,881 by Lev.
Office Action dated Nov. 11, 2013 in IL Application No. 218730.
Office Action dated Nov. 28, 2013 in IN Application No. 4348/DELNP/2008.
Office Action dated Nov. 29, 2010 in U.S. Appl. No. 11/568,421.
Office Action dated Oct. 5, 2005 in U.S. Appl. No. 10/062,796.
Office Action dated Oct. 5, 2015 in U.S. Appl. No. 14/385,212 by Lev.
Office Action dated Oct. 6, 2003 in U.S. Appl. No. 10/062,796.
Office Action dated Oct. 8, 2013 in CN Application No. 201080043825.1.
Office Action dated Sep. 28, 2010 in U.S. Appl. No. 12/112,490 by Zinger.
Office Action Issued in JP Application No. 2007-510229.
Translation of Office Action dated Apr. 15, 2013 in JP Application No. 2008-538492.
Translation of Office Action dated Jun. 18, 2012 in JP Application No. 2008-538492.
U.S. Appl. No. 14/005,751 by Denenburg, filed Sep. 17, 2013.
U.S. Appl. No. 13/498,378 by Lev, filed Mar. 27, 2012.
U.S. Appl. No. 13/505,790 by Lev, filed May 3, 2012.
U.S. Appl. No. 13/505,881 by Lev, filed May 3, 2012.
U.S. Appl. No. 13/522,410 by Lev, filed Jul. 16, 2012.
U.S. Appl. No. 13/576,461 by Lev, filed Aug. 1, 2012.
U.S. Appl. No. 13/883,289 by Lev, filed May 3, 2013.
U.S. Appl. No. 13/884,981 by Denenburg, filed May 13, 2013.
U.S. Appl. No. 14/345,094 by Lev, filed Mar. 14, 2014.
U.S. Appl. No. 14/366,306 by Lev, filed Jun. 18, 2014.
U.S. Appl. No. 14/385,212 by Lev, filed Sep. 15, 2014.
U.S. Appl. No. 14/391,792 by Lev, filed Oct. 10, 2014.
U.S. Appl. No. 14/423,595 by Lev, filed Feb. 24, 2015.
U.S. Appl. No. 14/423,612 by Lev, filed Feb. 24, 2015.
U.S. Appl. No. 14/425,582 by Lev, filed Mar. 3, 2015.
U.S. Appl. No. 14/504,979 by Lev, filed Oct. 2, 2014.
U.S. Appl. No. 14/784,300 by Lev, filed Oct. 14, 2015.
U.S. Appl. No. 14/888,590 by Marks, filed Nov. 2, 2015.
U.S. Appl. No. 29/438,134 by Lev, filed Nov. 27, 2012.
Grifols Vial Adapter Product Literature, 2 pages, Jan. 2002. cited by other.
Novel Transfer, Mixing and Drug Delivery Systems, MOP Medimop Medical Projects Ltd. Catalog, 4 pages, Rev. 4, 2004. cited by other.
Smart Site.RTM. Alaris Medical Systems Product Brochure, 4 pages, Issue 1, Oct. 1999. cited by other.
MixJect, downloaded from webpage: http://www.westpharma.com/en/products/Pages/Mixject.aspx, Download Date: Aug. 8, 2012, 1 page.
MixJet Product Information Sheet, downloaded from webpage: http://www.westpharma.com/SiteCollectionDocuments/Recon/mixject%20product%20sheet.pdf; 1 page.
The MixJect transfer system, as shown in the article, "Advanced Delivery Devices," Drug Delivery Technology Jul./Aug. 2007 vol.7 No. 7 [on-line], [Retrieved from Internet May 14, 2010.] URL: <http://www.drugdeiverytech-online.com/drugdelivery/200707/?pg=28pg28>. (3 pages).
Publication date of Israeli Patent Application 186290 [on-line]. ]Retrieved from Internet May 24, 2010]. URL:<http://www.lpatsearch.justrice.gov.il/UI/RequestsList.aspx>. (1 page).
Silicone Rubber Overview Downloaded from webpage: http://www.knovel.com/web/portal/browse/display?_EXT_KNOVEL_DISPLAY_bookid=1023&VerticalID=0 on Feb. 9, 2011, Download Date: Sep. 2, 2011, Original Posting Date: 2010, 6 pages.
Kipp, "Plastic Material Data Sheets," retrieved from the internet: http://www.knovel.com/web/portal/browse/display?_EXT_KNOVEL_DISPLAY_bookid=1023&VerticalID=0, retrieved on Feb. 9, 2011.
Alaris Medical Systems Product Brochure, 4 pages, Issue 1, Oct. 11, 1999.
Smart Site Needle-Free Systems, Alaris Medical Systems Webpage, 4 pages, Feb. 2006.
Photographs of Alaris Medical Systems SmartSite.RTM. device, 5 pages, 2002.
Non-Vented Vial Access Pin with ULTRASITE.RTM. Valve, B. Braun Medical, Inc. website and product description, 3 pages, Feb. 2006.
IV disposables sets catalogue, Cardinal Health, Alaris® products, SmartSite® access devices and accessories product No. 10013365, SmartSite add-on bag access device with spike adapter and needle-free valve bag access port, pp. 1-5, Fall edition (2007).
Drug Administration Systems product information sheets; http://www.westpharma.com/eu/en/products/Pages/Vial2Bag.aspx; pp. 1-3 (admitted prior art).
West, Vial2Bag DC system, Oct. 2, 2014, https://web.archive.org/web/20141002065133/http://www.westpharma.com/en/products/Pages/Reconstitutionsystems.aspx.
Vial2Bag DC, downloaded from webpage: https://www.youtube.com/watch?v=FEOkglxNBrs, Original posting date: Aug. 21, 2014, 1 page.
Vial-Mate Adapter Device, Baxter, May 2017, downloaded from web page:http://www. baxtermedicationdeliveryproducts.com/drug-delivery/vialmate.html, Download Date: Jul. 28, 2017, original posting date: unknown, 1page.
Summit International Medical Technologies, Inc., Vial Direct to Bag Spike, 2020.
Merchant "An engineered control device for needle free reconstitution and transfer of compounded sterile intravenous drug solutions for immediate use to assist in complying with United States Pharmacopeia Chapter <797> standard", Adv Care, 2 pages, 2018.
Int'l Search Report and Written Opinion dated Dec. 3, 2018 in Int'l Application No. PCT/IL2018/051061.
Article with picture of West Pharmaceutical Services' Vial2Bag Needleless System, [on-line]; !Sips Newsletter, Oct. 26, 2007]; retrieved from Internet Feb. 16, 2010]; URL:<http://www.isips.org/reports/ISIPS_Newsletter_October_26_2007.html> (7 pages. see pp. 5-6).
Decision to Grant dated Apr. 12, 2010 in EP Application No. 08738307.1.
English translation of an Office Action dated Apr. 28, 2014 in JP Application No. 2013-537257.
English translation of an Office Action dated Aug. 28, 2014 in JP Application No. 2013-168885.
English translation of an Office Action dated Dec. 25, 2013 in CN Application No. 201180006530.1.
English translation of an Office Action dated Dec. 4, 2013 in CN Application No. 201080051210.3.
English translation of an Office Action dated Feb. 4, 2014 in JP Application No. 2012-554468.
English translation of an Office Action dated Jan. 9, 2014 in JP Application No. 2010-526421.
English translation of an Office Action dated Jul. 26, 2013 in JP Application No. 2012-538464.
English translation of an Office Action dated Jun. 19, 2013 in JP Application No. 2012-531551.
English translation of an Office Action dated Jun. 30, 2014 in CN Application No. 201180052962.6.

(56) References Cited

OTHER PUBLICATIONS

English translation of an Office Action dated Sep. 10, 2013 in JP Application No. 2012-554468.
Extended European Search Report dated Feb. 16, 2017 in EP Application No. 16200458.
Extended European Search Report dated Jun. 3, 2014 in EP Application No. 08781828.2.
http://www.knovel.com/web/portal/browse/display?.sub.—EXT.sub.—KNOVEL.su-b.—DISPLAY.sub.—bookid=1023&VerticalID=0 [retrieved on Feb. 9, 2011].
http://www.westpharma.com/en/products/Pages/Mixject.aspx (admitted prior art), [Retrieved on Aug. 8, 2012].
http://www.westpharma.com/eu/SiteCollectionDocuments/Recon/mixject%20produ- ct%20sheet.pfg: MIXJECT product information sheet pp. 1, Sep. 10, 2010.
Int'l Preliminary Report on Patenability dated Oct. 20, 2009 in Int'l Application No. PCT/IL2008/000517.
Int'l Preliminary Report on Patentability dated Jan. 14, 2014 in Int'l Application No. PCT/IL2012/050516.
Int'l Preliminary Report on Patentability dated Apr. 1, 2014 in Int'l Application No. PCT/IL2013/050180.
Int'l Preliminary Report on Patentability dated May 6, 2008 in Int'l Application No. PCT/IL2006/001228.
Int'l Preliminary Report on Patentability dated May 12, 2014 in Int'l Application No. PCT/IL2013/050316.
Int'l Preliminary Report on Patentability dated Aug. 20, 2014 in Int'l Application No. PCT/IL2012/050407.
Int'l Preliminary Report on Patentability dated Aug. 28, 2012 in Int'l Application No. PCT/IL2011/000186.
Int'l Preliminary Report on Patentability dated Sep. 24, 2013 in Int'l Application No. PCT/IL2012/000354.
Int'l Preliminary Report on Patentability dated Dec. 4, 2007 in Int'l Application No. PCT/IL2006/000912.
Int'l Preliminary Report on Patentability dated Jun. 19, 2006 in Int'l Application No. PCT/IL2005/000376.
Int'l Preliminary Report on Patentability dated Jun. 19, 2008 in Int'l Application No. PCT/IL2007/000343.
Int'l Search Report & Written Opinion dated Mar. 7, 2012 in Int'l Application No. PCT/IL2011/000829.
Int'l Search Report and Written Opinion dated Mar. 6, 2012 in Int'l Application No. PCT/IL2011/000834.
Int'l Search Report and Written Opinion dated May 8, 2014 in Int'l Application No. PCT/IL2013/050706.
Int'l Search Report and Written Opinion dated Jul. 16, 2014 in Int'l Application No. PCT/IL2014/050327.
Int'l Search Report and Written Opinion dated Sep. 2, 2014 in Int'l Application No. PCT/IL2014/050405.
Int'l Search Report dated Feb. 3, 2011 in Int'l Application No. PCT/IL2010/000777; Written Opinion.
Int'l Search Report dated Mar. 17, 2011 in Int'l Application No. PCT/IL2010/000854; Written Opinion.
Int'l Search Report dated Mar. 17, 2011 in Int'l Application No. PCT/IL2010/000915; Written Opinion.
Int'l Search Report dated Mar. 18, 2013 in Int'l Application No. PCT/IL2012/050516.
Int'l Search Report dated Jun. 5, 2013 in Int'l Application No. PCT/IL2012/050407.
Int'l Search Report dated Jun. 19, 2013 in Int'l Application No. PCT/IL2013/050167.
Int'l Search Report dated Jul. 1, 2013 in Int'l Application No. PCT/IL2013/050180.
Int'l Search Report dated Jul. 26, 2013 in Int'l Application No. PCT/IL2013/050316.
Int'l Search Report dated Jul. 31, 2013 in Int'l Application No. PCT/IL2013/050313.
Int'l Search Report dated Aug. 16, 2012 in Int'l Application No. PCT/IL2012/000164.
Int'l Search Report dated Oct. 17, 2005 in Int'l Application No. PCT/IL2005/000376.
Int'l Search Report dated Oct. 17, 2011 in Int'l Application No. PCT/IL2011/000511.
Int'l Search Report dated Nov. 25, 2010 in Int'l Application No. PCT/IL2010/000530.
Int'l Search Report dated Mar. 12, 2009 in Int'l Application No. PCT/IL2008/001278.
Int'l Search Report dated Mar. 27, 2009 in Int'l Application No. PCT/US2008/070024.
Int'l Search Report dated Jul. 12, 2011 in Int'l Application No. PCT/IL2011/000186.
Int'l Search Report dated Jul. 12, 2011 in Int'l Application No. PCT/IL2011/000187.
U.S. Appl. No. 29/438,141 by Gilboa, filed Nov. 27, 2012.
U.S. Appl. No. 29/478,723 by Lev, filed Jan. 8, 2014.
U.S. Appl. No. 29/478,726 by Lev, filed Jan. 8, 2014.
U.S. Appl. No. 29/502,037 by Lev, filed Sep. 11, 2014.
U.S. Appl. No. 29/502,053 by Lev, filed Sep. 11, 2014.
U.S. Appl. No. 29/544,969 by Ben Shalom, filed Nov. 9, 2015.
U.S. Appl. No. 29/1438,134, Lev, filed Nov. 27, 2012.
U.S. Appl. No. 29/1438,141, Gilboa, filed Nov. 27, 2012.
West Drug Administration Systems, http://www.westpharma.com/eu/en/products/Pages/Mixject.aspx. Copyright 2010, West Pharmaceutical Services, Inc. 1 page.
Written Opinion dated Aug. 16, 2012 in Int'l Application No. PCT/IL2012/000164.
Written Opinion dated Jul. 1, 2013 in Int'l Application No. PCT/IL2013/050180.
Written Opinion dated Jul. 31, 2013 in Int'l Application No. PCT/IL2013/050313.
Written Opinion dated Jun. 5, 2013 in Int'l Application No. PCT/IL2012/050407.
Written Opinion of ISR dated Jun. 19, 2006 in Int'l Application No. PCT/IL2005/000376.
Written Opinion of the Int'l Searching Authority dated Oct. 27, 2008 in Int'l Application No. PCT/US2008/070024.
Written Opinion of the ISR dated Oct. 17, 2009 in Int'l Application No. PCT/IL08/00517.

* cited by examiner

DUAL VIAL ADAPTER ASSEMBLAGES INCLUDING TWIN VENTED FEMALE VIAL ADAPTERS

CROSS-REFERENCE TO RELATED APPLICATIONS

This application is a Section 371 of International Application No. PCT/IL2018/051061, filed Sep. 20, 2018, which was published in the English language on Apr. 4, 2019, under International Publication No. WO 2019/064296 A1, which claims priority under 35 U.S.C. § 119(b) to Israeli Application No. 254802, filed Sep. 29, 2017, the disclosures of each of which are incorporated herein by reference.

FIELD OF THE INVENTION

The invention relates to dual vial adapter assemblages for use with a drug vial containing a medicament and a liquid vial containing liquid contents.

BACKGROUND OF THE INVENTION

Dual vial adapter assemblages for use with a drug vial containing a medicament and a liquid vial containing liquid contents for mixing with or reconstituting the medicament in the drug vial to form a liquid drug include a drug vial adapter for telescopic mounting on the drug vial for puncturing same and a liquid vial adapter for telescopic mounting on the liquid vial for puncturing same. Dual vial adapter assemblages can be generally classified into two types as follows: A negative pressure type intended to be used with a drug vial under negative pressure for positively drawing liquid contents from a liquid vial thereinto. A gravitational flow type employing a venting arrangement for gravitational flow of liquid contents from a liquid vial to a drug vial. The former type requires initial telescopic mounting on a liquid vial and subsequent telescopic mounting on a drug vial and is generally intended for preparing a small liquid drug dosage. The latter type does not require a specific order of telescopic mounting on a liquid vial and a drug vial and is generally intended for preparing a large liquid drug volume suitable for aspiration of several liquid drug dosages or use with an IV set for infusion.

One exemplary dual vial adapter assemblage of the gravitational type is disclosed in commonly owned U.S. Pat. No. 8,752,598 to Denenburg et al. entitled Liquid Drug Transfer Assembly. U.S. Pat. No. '598 FIG. 9 shows a dual vial adapter assemblage including a drug vial adapter having a female connector and a liquid vial adapter having a dual lumen dual ended liquid transfer spike for puncturing both a liquid vial stopper and a drug vial stopper. A user has to correctly distinguish between the drug vial adapter and the liquid vial adapter such that liquid drug is formed in the drug vial thereby enabling attachment of a needleless syringe to the drug vial adapter for aspiration of liquid drug therefrom. However, the drug vial adapter and the liquid vial adapter have a high degree of resemblance which can lead to confusion therebetween which in turn can lead to the liquid drug being formed in the liquid vial thereby precluding attachment of a needleless syringe to the liquid vial adapter having the dual lumen dual ended liquid transfer spike.

Additional dual vial adapter assemblages are disclosed in commonly owned PCT International Application No. PCT/IL2017/050527 entitled Dual Vial Adapter Assemblages including Vented Drug Vial Adapter and Vented Liquid Vial Adapter and published under PCT International Publication No. WO 2017/203512 as follows: FIG. 1 to FIG. 5 disclose a vented female drug vial adapter and a vented male liquid vial adapter; FIG. 6 to FIG. 8 disclose identical dual vented female vial adapters and an intermediate dual ended liquid transfer coupler having an opposite pair of male connectors. FIG. 9 to FIG. 11 disclose identical dual vented male vial adapters and an intermediate dual ended liquid transfer coupler having an opposite pair of female connectors. The dual vial adapter assemblages with identical dual vented vial adapters afford the advantage that the vented vial adapters can be equally telescopically mounted on a drug vial or a liquid vial thereby precluding the need for a user to distinguish between a drug vial adapter and a liquid vial adapter. The vented vial adapters are preferably designed for quick release from a vial as disclosed in PCT International Publication No. WO 2012/150587 entitled Vial Adaptor. Accordingly, a vented vial adapter can be readily removed from a drug vial containing a liquid drug thereby exposing its drug vial stopper for insertion of an IV set for infusion of the liquid drug to a patient.

There is a need for dual vial adapter assemblages for improved gravitational flow from a liquid vial to a drug vial for forming liquid drug contents in the drug vial.

SUMMARY OF THE INVENTION

The present invention is directed towards dual vial adapter assemblages having a triple component construction as follows: a first vented female vial adapter for telescopic mounting on a drug vial, a second vented female vial adapter for telescopic mounting on a liquid vial and a tubular liquid transfer coupler for coupling the first vented female vial adapter and the second vented female vial adapter for establishing a dual sealed lumen arrangement therebetween. The dual sealed lumen arrangement includes a central sealed liquid lumen for gravitational flow of liquid contents from a liquid vial to a drug vial on disposing the former above the latter and at least one sealed air lumen radial outward from the central sealed liquid lumen for venting air displaced from the drug vial to the liquid vial for assisting the gravitational flow of liquid contents by creating a closed system between the liquid vial and the drug vial. The liquid transfer coupler is preferably designed such that a sealed air lumen preferably surrounds a central sealed liquid lumen and is concentric therewith. The dual vial adapter assemblages of the present invention are preferably provided in a set-up position ready for immediate use on removal from suitable sterile packaging. Alternatively, the dual vial adapter assemblages may require assembly by a user before use.

BRIEF DESCRIPTION OF DRAWINGS

In order to understand the invention and to see how it can be carried out in practice, preferred embodiments will now be described, by way of non-limiting examples only, with reference to the accompanying drawings in which similar parts are likewise numbered, and in which.

DETAILED DESCRIPTION OF PREFERRED EMBODIMENTS OF THE INVENTION

Figure 1:
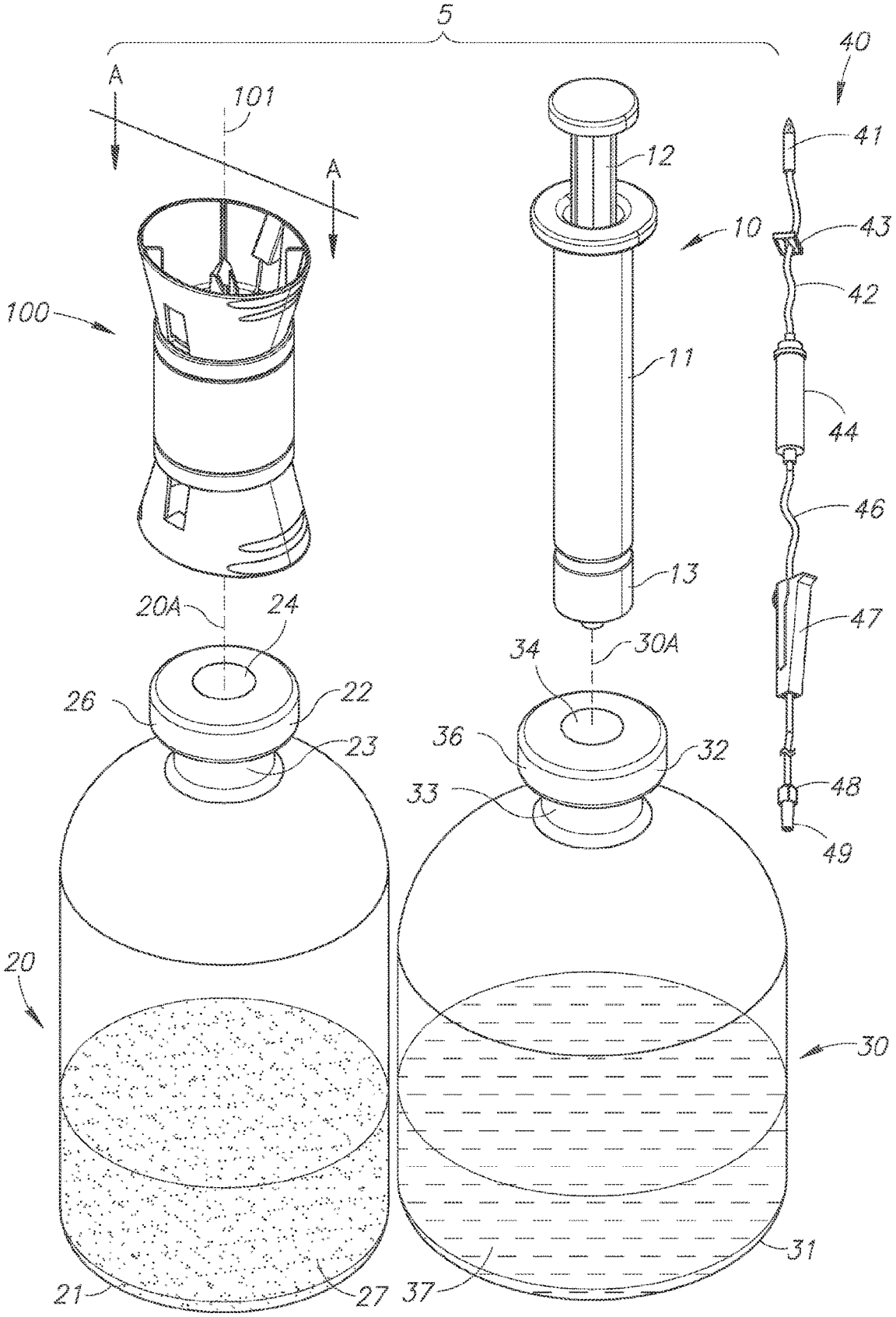
FIG. 1 is a pictorial view of an administration set including a needleless syringe, a drug vial, a liquid vial, an infusion set, and a dual vial adapter assemblage in accordance with a first preferred embodiment of the present invention.

FIG. 1 shows an administration set 5 including an initially empty needleless syringe 10, a drug vial 20, a liquid vial 30, an infusion set 40 (shown in a reduced scale) and a dual vial adapter assemblage 100. The needleless syringe 10 includes a barrel 11 with a plunger 12 and a male Luer lock connector 13. The syringe 10 can be formed with other types of male connectors. The drug vial 20 has a longitudinal drug vial axis 20A and includes an open topped drug vial bottle 21 having a drug vial crown 22 and a narrow diameter drug vial neck 23. The drug vial crown 22 is sealed by a drug vial stopper 24. The drug vial stopper 24 is sealed by an aluminum band 26. The drug vial 20 contains a medicament 27 in the form of a powder, solid or liquid. The liquid vial 30 has a longitudinal liquid vial axis 30A and includes an open topped liquid vial bottle 31 having a liquid vial crown 32 and a narrow diameter drug vial neck 33. The liquid vial crown 32 is sealed by a liquid vial stopper 34. The liquid vial stopper 34 is sealed by an aluminum band 36. The liquid vial 30 includes liquid contents 37 in the form of diluent only or an active component. The IV infusion set 40 includes an IV spike 41, first tubing 42, a clamp 43, a drip chamber 44, second tubing 46, a roller clamp 47, a male Luer connector 48, and a Luer shield 49. First tubing 42 typically have dimensions 4.1 mm×200 mm and second tubing 46 typically have dimensions 4.1 mm×500 mm.

Figure 2:
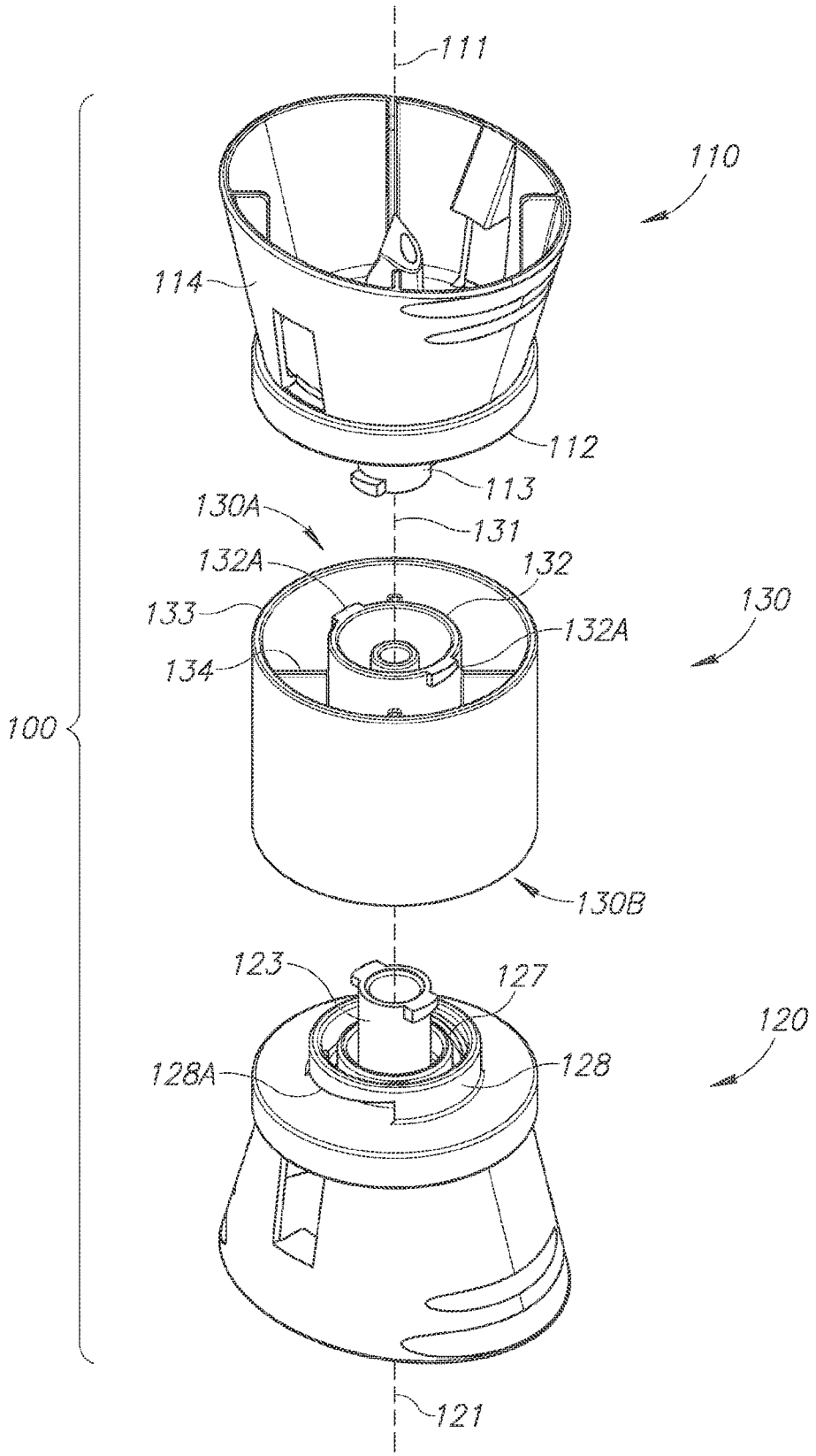
FIG. 2 is an exploded view of the FIG. 1 dual vial adapter assemblage.
Figure 3:
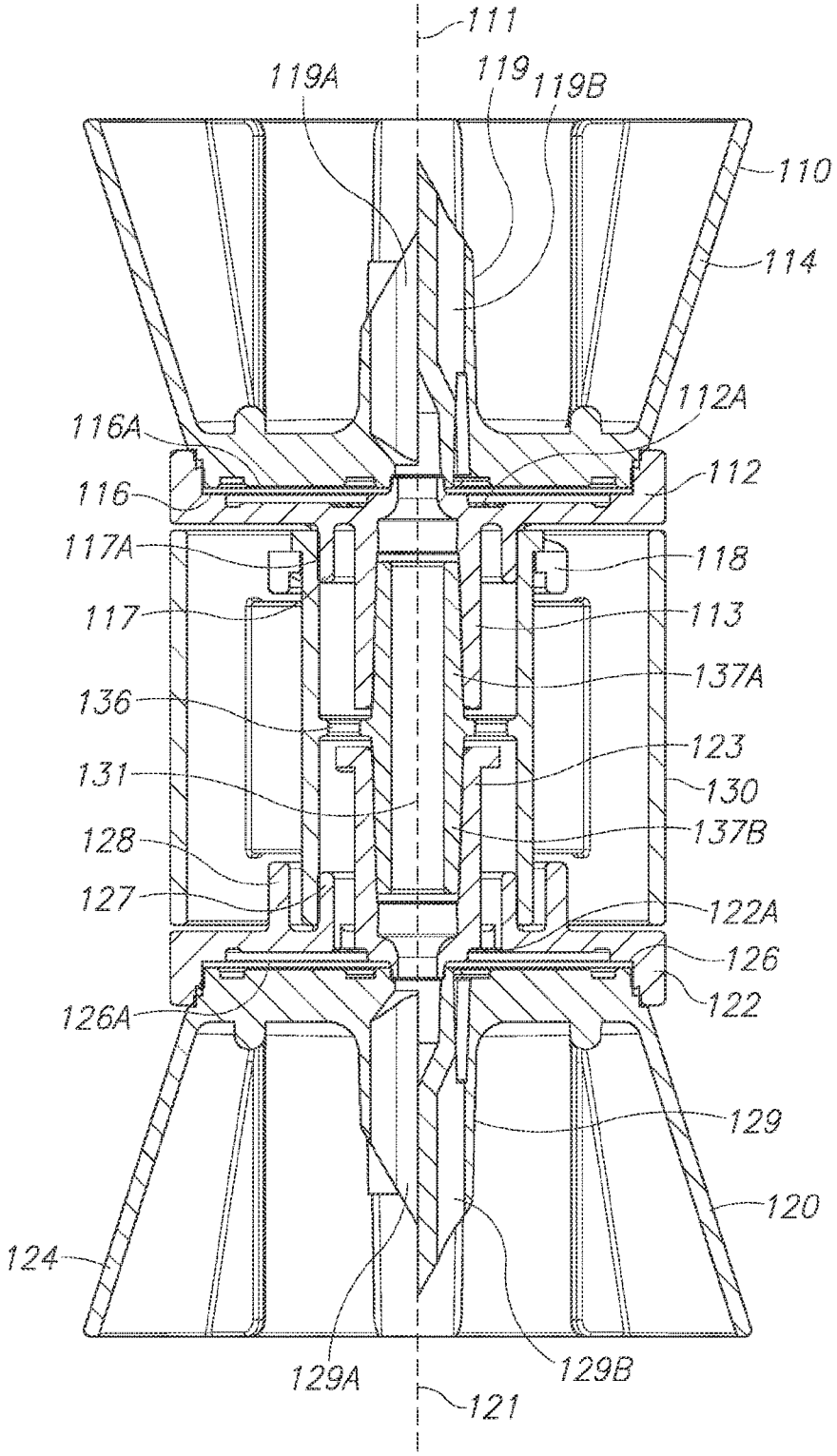
FIG. 3 is a longitudinal cross section of the FIG. 1 dual vial adapter assemblage along line A-A in FIG. 1.
Figure 4:
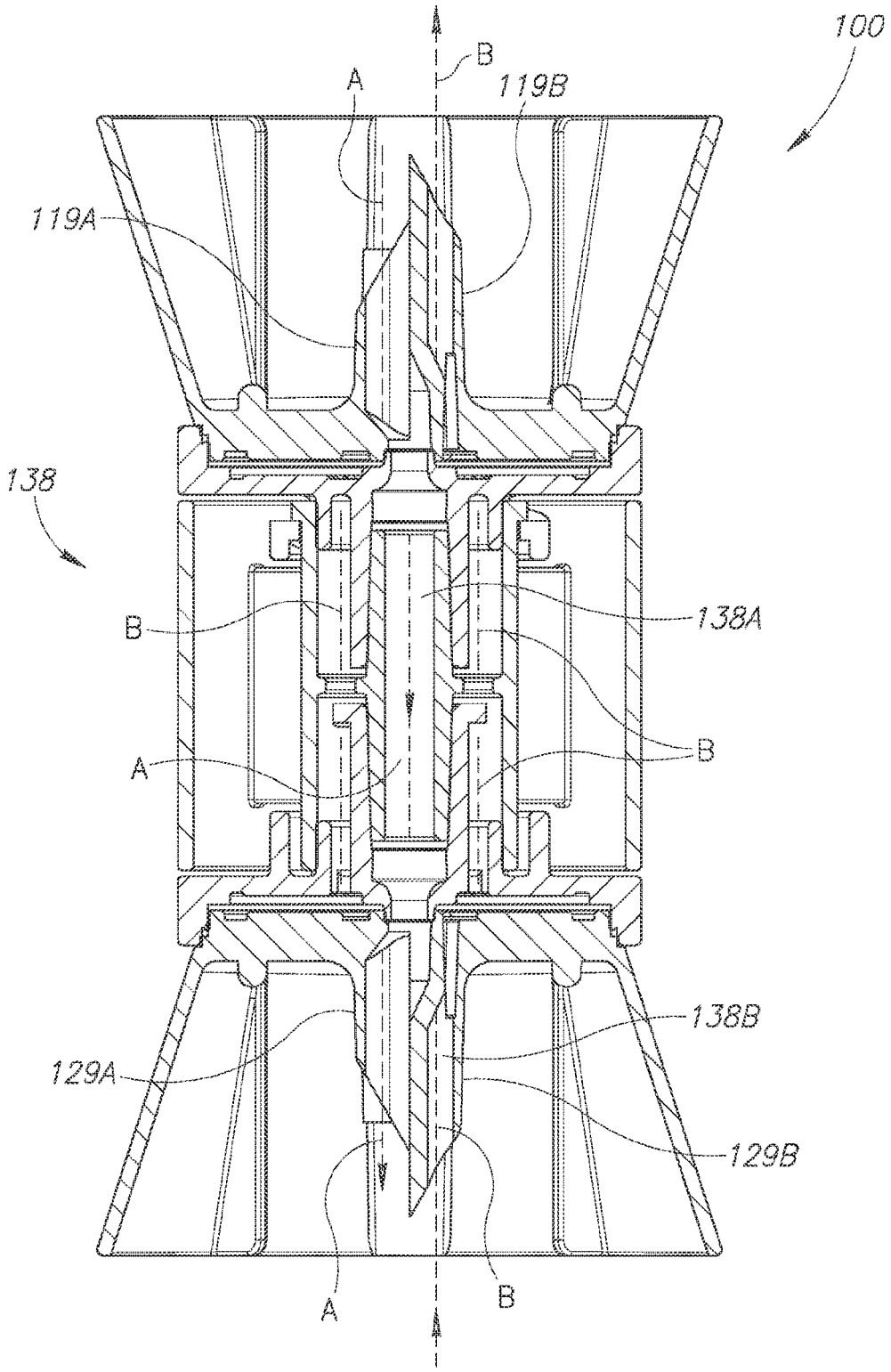
FIG. 4 is a longitudinal cross section of the FIG. 1 dual vial adapter assemblage along line A-A in FIG. 1 showing transfer of liquid contents from a liquid vial to a drug vial and venting of air displaced from the drug vial to the liquid vial.

FIG. 2 to FIG. 4 show the dual vial adapter assemblage 100 has a longitudinal dual vial adapter assemblage centerline 101 and includes a triple component construction including a first vented female vial adapter 110 for telescopic mounting on the drug vial 20, a second vented female vial adapter 120 for telescopic mounting on the liquid vial 30 and a tubular liquid transfer coupler 130 for coupling the first vented female vial adapter 110 and the second vented female vial adapter 120.

The first vented female vial adapter 110 has a longitudinal first vented female vial adapter centerline 111 and includes a transverse first vented female vial adapter top wall 112 having an upright first vented female vial adapter female connector 113 and a diametric pair of first vented female vial adapter top wall vents 112A radial outward from the upright first vented female vial adapter female connector 113 relative to the longitudinal first vented female vial adapter centerline 111. The upright first vented female vial adapter female connector 113 is preferably constituted by a female Luer connector including an external screw thread for screw thread engagement by a male Luer lock connector. The first vented female vial adapter 110 includes a first vented female vial adapter skirt 114 for telescopic mounting on the drug vial 20 and an annular air filter cavity 116 disposed between the transverse first vented female vial adapter top wall 112 and the first vented female vial adapter skirt 114. The annular air filter cavity 116 includes an annular air filter 116A.

The first vented female vial adapter top wall 112 includes an interior annular surround 117 radial outward from the diametric pair of first vented female vial adapter top wall vents 112A relative to the longitudinal first vented female vial adapter centerline 111. The first vented female vial adapter top wall 112 includes an exterior annular surround 118 surrounding the interior annual surround 117 and in close proximity thereto for defining an annular groove therebetween. The interior annular surround 117 has an external peripheral sealing surface 117A facing the exterior annular surround 118. The exterior annular surround 118 includes an opposite pair of engagement grooves for engagement purposes. The interior surround 117 and the exterior surround 118 are not necessarily annular but are necessarily radial outward from the diametric pair of first vented female vial adapter top wall vents 112A relative to the longitudinal first vented female vial adapter centerline 111.

The first vented vial adapter skirt 114 includes a first dual lumen vial stopper puncturing cannula 119 for puncturing the drug vial stopper 24 on telescopic mounting the first vented female vial adapter 110 on the drug vial 20. The first dual lumen vial stopper puncturing cannula 119 includes a liquid lumen 119A in flow communication with the first vented female vial adapter connector 113 and an air lumen 119B in flow communication with the diametric pair of vented female vial adapter top wall vents 112A.

The second vented female vial adapter 120 has a longitudinal second vented female vial adapter centerline 121 and includes a transverse second vented female vial adapter top wall 122 having an upright second vented female vial adapter female connector 123 and a diametric pair of second vented female vial adapter top wall vents 122A radial outward from the upright second vented female vial adapter female connector 123 relative to the longitudinal second vented female vial adapter centerline 121. The upright second vented female vial adapter female connector 123 is preferably constituted by a female Luer connector including an external screw thread for screw thread engagement by a male Luer lock connector. The second vented female vial adapter 120 includes a second vented female vial adapter skirt 124 for telescopic mounting on the liquid vial 30 and an annular air filter cavity 126 disposed between the transverse second vented female vial adapter top wall 122 and the second vented female vial adapter skirt 124. The annular air filter cavity 126 includes an annular air filter 126A.

The second vented female vial adapter top wall 122 includes an interior annular surround 127 radial outward from the diametric pair of second vented female vial adapter top wall vents 122A relative to the longitudinal second vented female vial adapter centerline 121 and surrounding the upright second vented female vial adapter female connector 123. The second vented female vial adapter top wall 122 includes an exterior annular surround 128 surrounding the interior annular surround 127 and in close proximity thereto for defining an annular groove therebetween. The interior annular surround 127 has an external peripheral sealing surface 127A facing the exterior annular surround 128. The exterior annular surround 128 includes an opposite pair of engagement grooves 128A. The interior surround 127 and the exterior surround 128 are not necessarily annular but are necessarily radial outward from the diametric pair of first vented female vial adapter top wall vents 122A relative to the longitudinal first vented female vial adapter centerline 121.

The second vented vial adapter skirt 124 includes a second dual lumen vial stopper puncturing cannula 129 for puncturing the liquid vial stopper 34 on telescopic mounting the second vented female vial adapter 120 on the liquid vial 30. The second dual lumen vial stopper puncturing cannula 129 includes a liquid lumen 129A in flow communication with the second vented female vial adapter connector 123 and an air lumen 129B in flow communication with the diametric pair of vented female vial adapter top wall vents 122A.

The first vented female vial adapter 110 and the second vented female vial adapter 120 are preferably of the quick release type as disclosed in PCT International Publication No. WO 2012/150587 entitled Vial Adaptor.

The liquid transfer coupler 130 has a longitudinal liquid transfer coupler centerline 131 and includes a first liquid transfer coupler end 130A for engaging the first vented female vial adapter 110 and a second liquid transfer coupler end 130B for engaging the second vented female vial adapter 120 in a set-up position of the dual vial adapter assemblage 100. The liquid transfer coupler 130 includes an air lumen wall 132 and an external wall 133 mounted on thereon by way of radial vanes 134. The external wall 133 extends between circumferences of the transverse first vented female vial adapter top wall 112 and the transverse second vented female vial adapter top wall 122 for assisting handling of the dual vial adapter assemblage 100. The air lumen wall 132 includes an internal annular transverse flange 136 having an upright first male connector 137A for sealing insertion in the upright first vented female vial adapter female connector 113 and an opposite directed second male connector 137B for sealing insertion in the upright second vented female vial adapter female connector 123.

The air lumen wall 132 has an opposite pair of outward radial directed engagement projections 132A at the liquid transfer coupler end 130A for engagement with the engagement grooves and an opposite pair of outward radial directed engagement projections 132B (not shown) at the liquid transfer coupler end 130B for engagement with the engagement grooves 128A in the set-up position of the dual vial adapter assemblage 100. In the set-up position of the dual vial adapter assemblage 100, the air lumen wall 132 is intended to be slidingly inserted between the interior annular surround 117 and the external annular surround 118 at the first liquid transfer coupler end 130A and the interior annular surround 127 and the external annular surround 128 at the second liquid transfer coupler end 130B. The air lumen wall 132 seals against the external peripheral sealing surface 117A at the first liquid transfer coupler end 130A and the external peripheral sealing surface 127A at the second liquid transfer coupler end 130B.

In the set-up position of the dual vial adapter assemblage 100, the liquid transfer coupler 130 simultaneously establishes a dual sealed lumen arrangement 138 including a central sealed liquid lumen 138A between the first vented female vial adapter female connector 113 and the second vented female vial adapter female connector 123 and a sealed air lumen 138B surrounding the liquid lumen 138A for sealed flow communication between the diametric pair of first vented female vial adapter top wall vents 112A and the diametric pair of second vented female vial adapter top wall vents 122A. Accordingly, the dual vial adapter assemblage 100 creates a closed system between a liquid vial and a drug vial for assisting gravitational flow of liquid contents from the liquid vial to the drug vial. FIG. 4 shows gravitational flow of liquid contents from the liquid vial 30 to the drug vial 20 through the sealed liquid lumen 138A denoted by arrow A and venting of air displaced from the drug vial 20 to the liquid vial 30 through the air lumen 119B, the sealed air lumen 138B and the air lumen 129B denoted by arrow B.

Figure 5A:
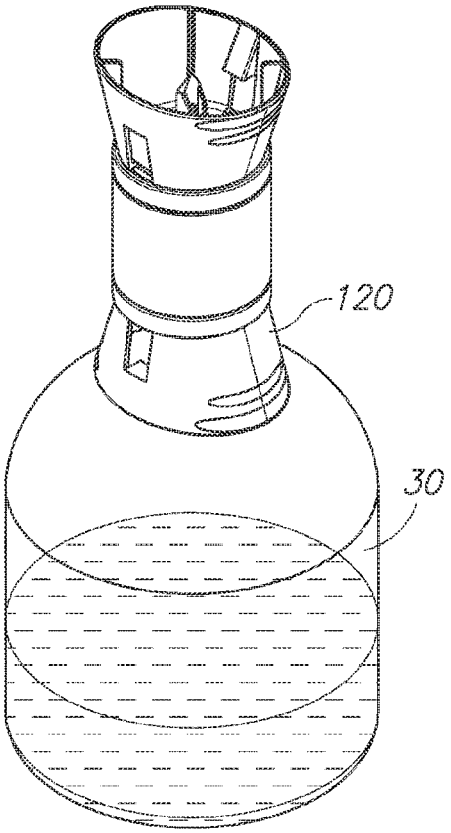
FIG. 5A to FIG. 5F show the use of the administration set.
Figure 5B:
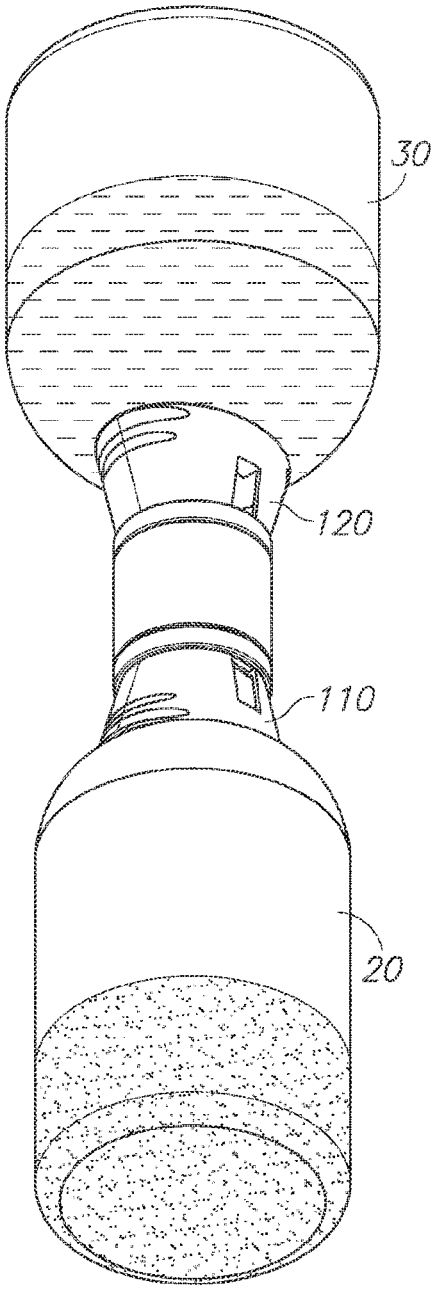
Figure 5C:
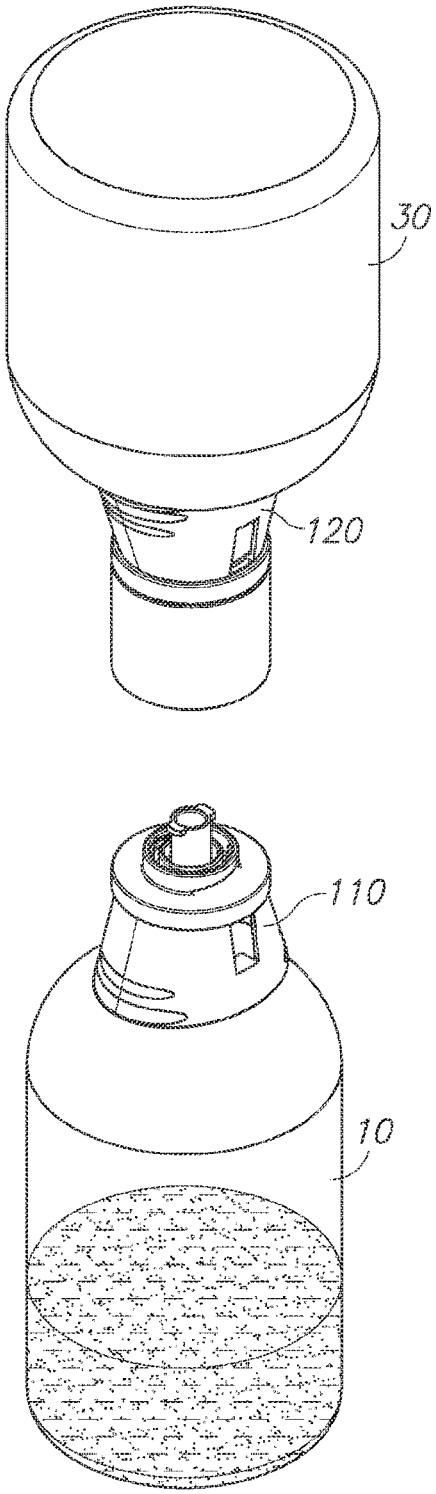
Figure 5D:
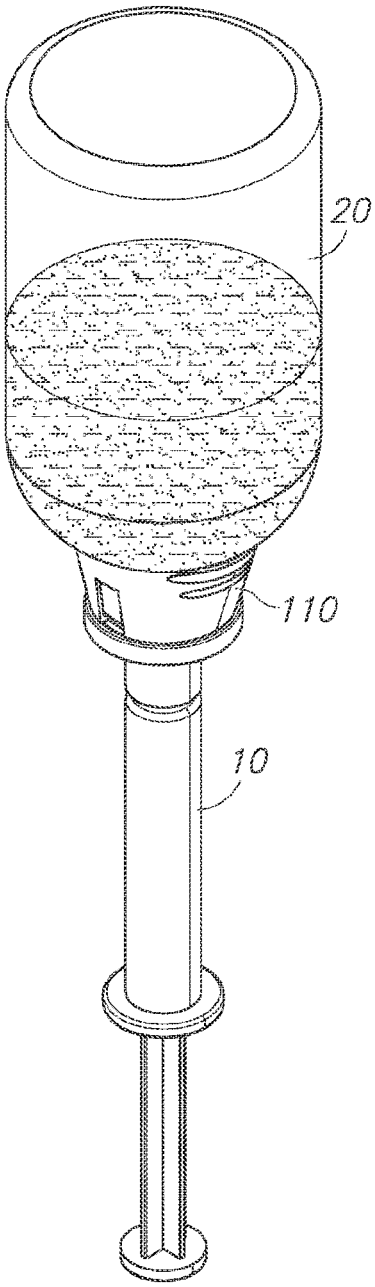
Figure 5E:
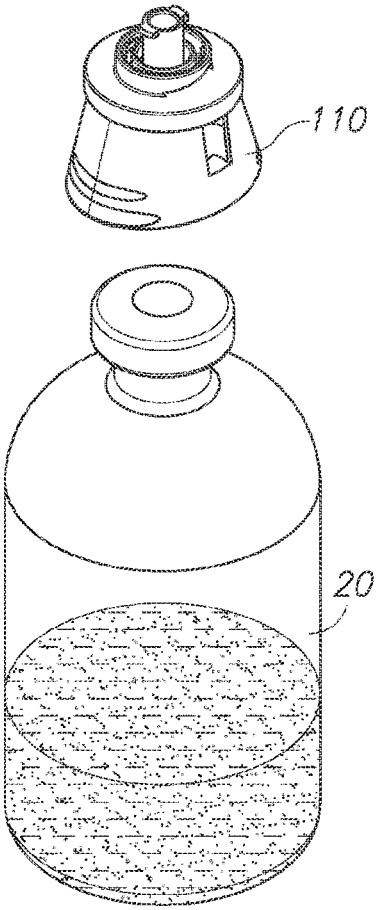
Figure 5F:
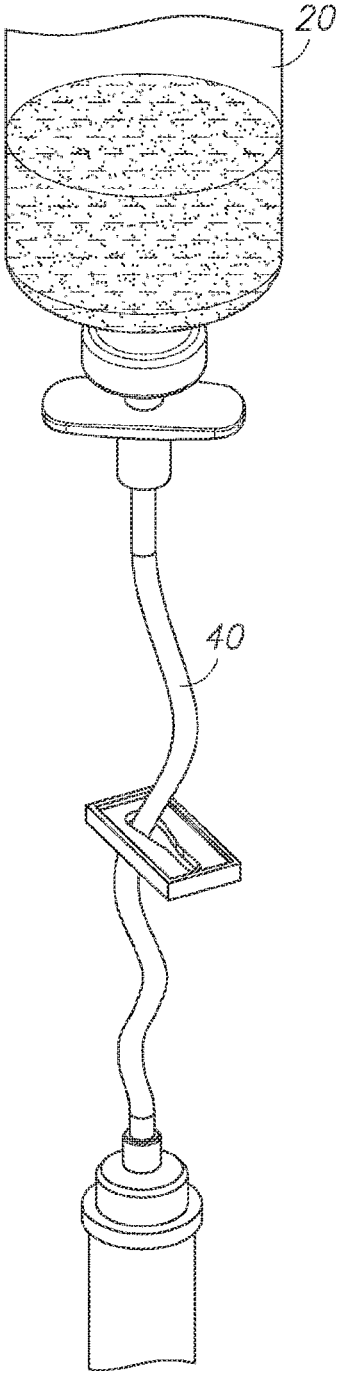
Figure 6:
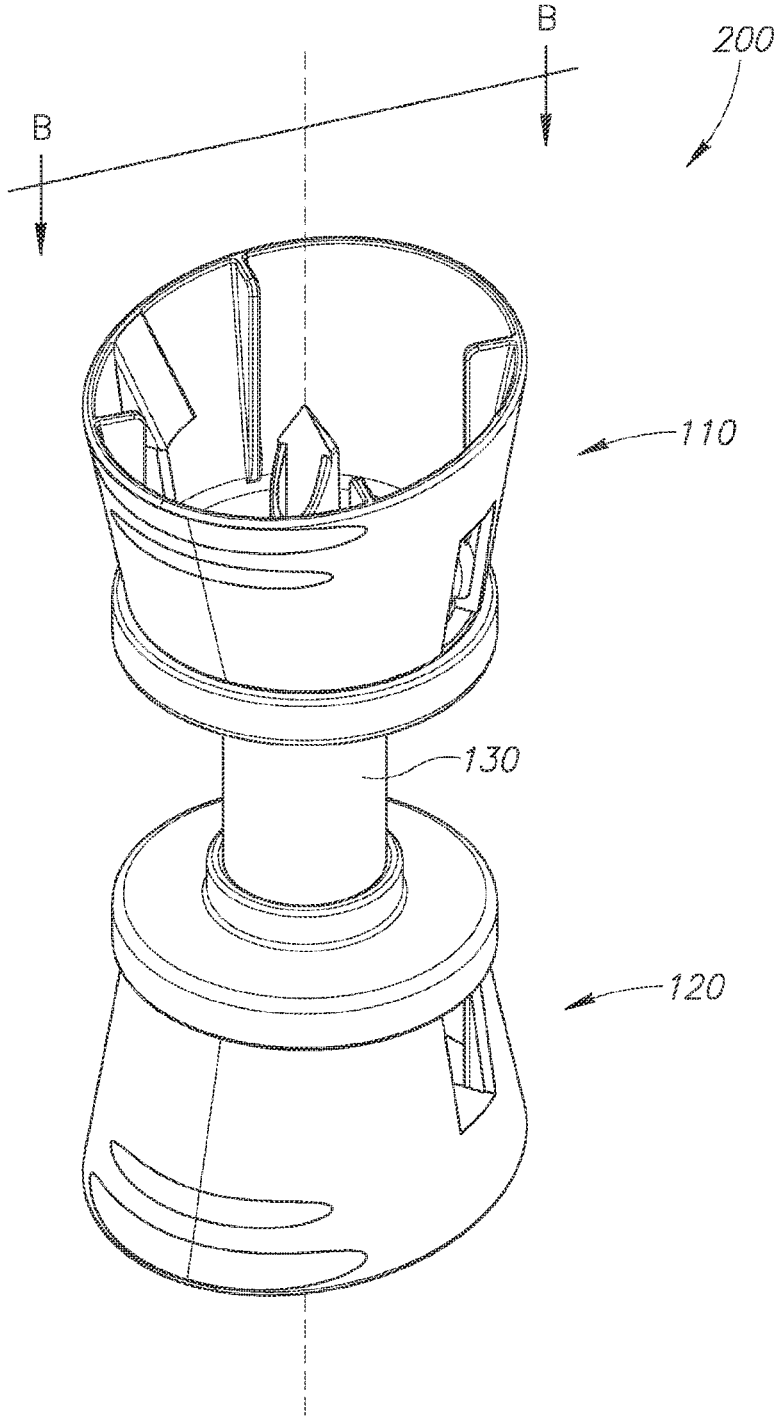
FIG. 6 is a perspective view of a dual vial adapter assemblage in accordance with a second preferred embodiment of the present invention.
Figure 7:
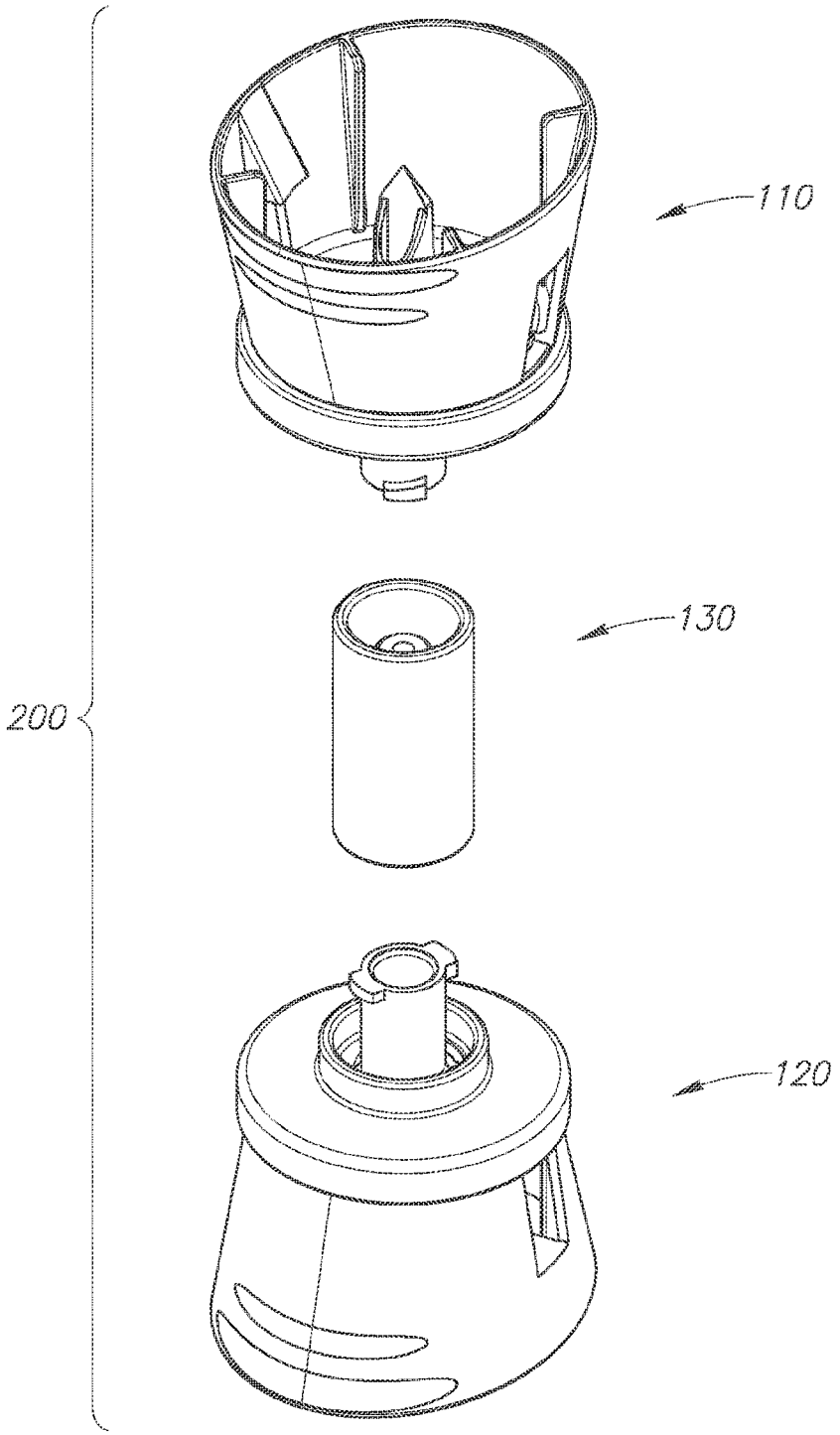
FIG. 7 is an exploded view of the FIG. 6 dual vial adapter assemblage.
Figure 8A:
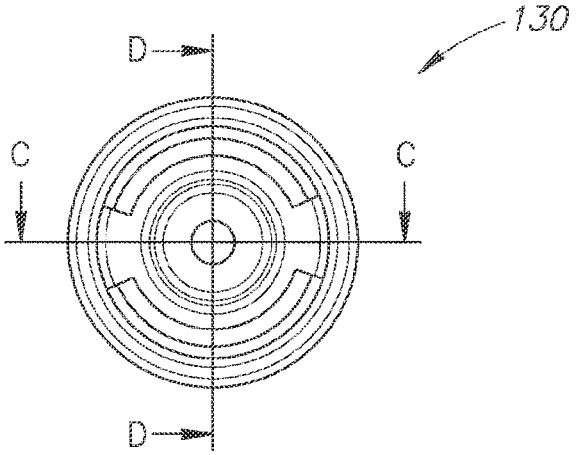
FIG. 8A is a top view of a liquid transfer coupler of the FIG. 6 dual vial adapter assemblage.
Figure 8B:
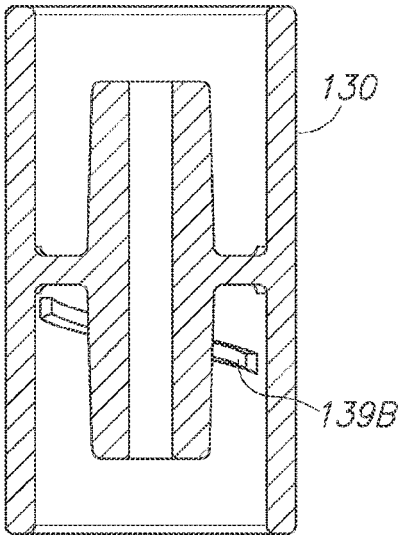
FIG. 8B is a longitudinal cross section view of the FIG. 6 liquid transfer coupler along line C-C in FIG. 8A.
Figure 8C:
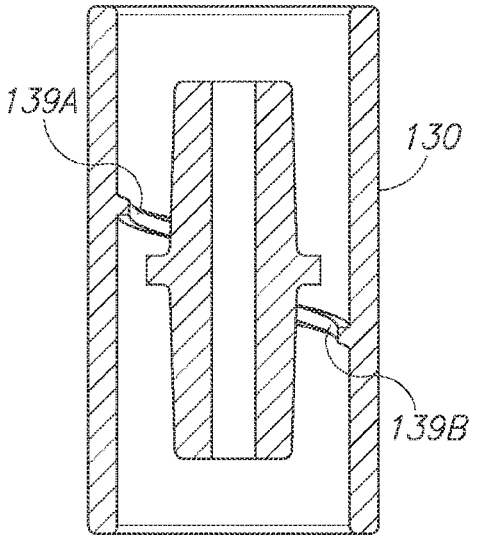
FIG. 8C is a longitudinal cross section of the FIG. 6 liquid transfer coupler along line D-D in FIG. 8A.
Figure 9:
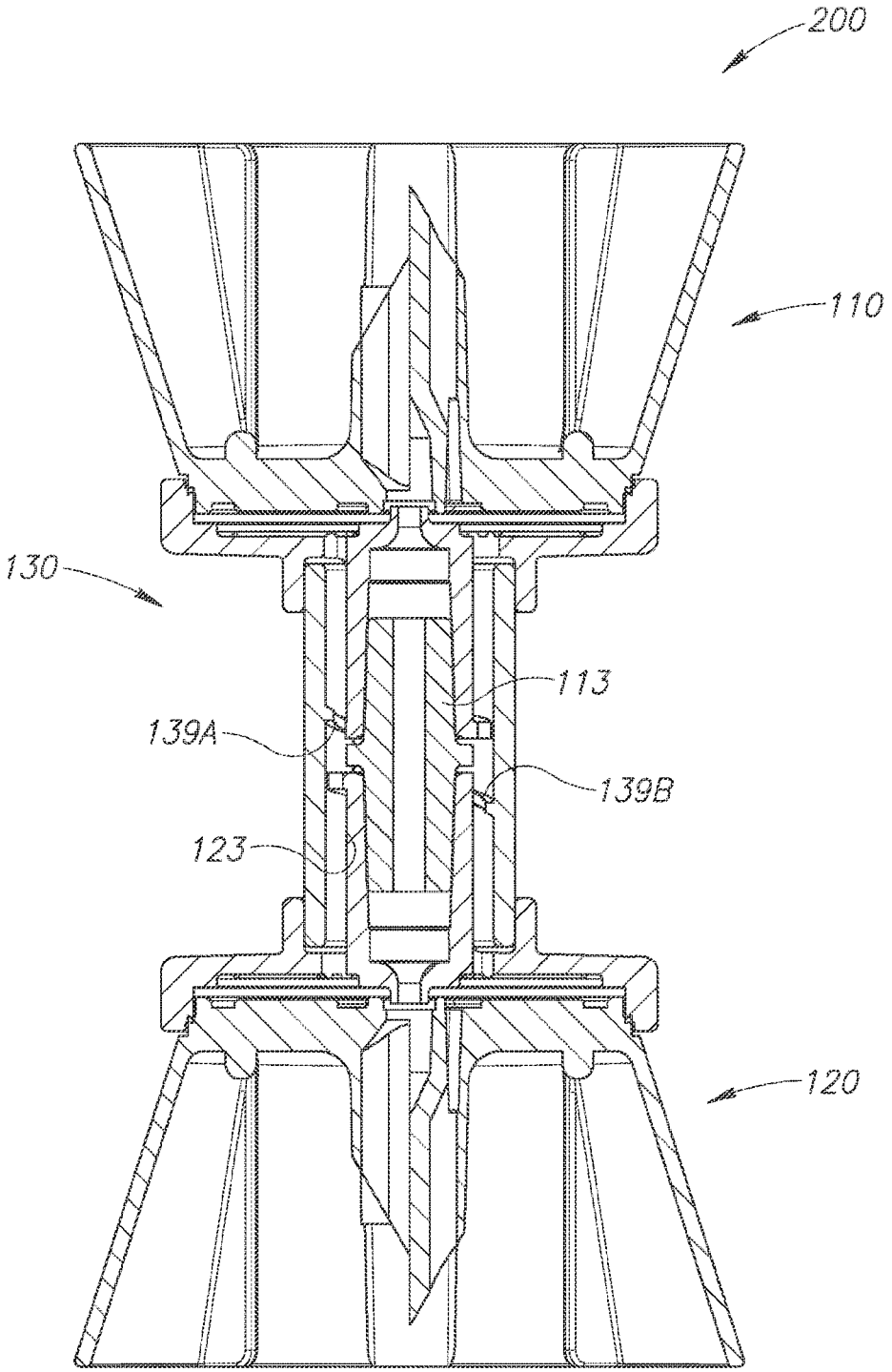
FIG. 9 is a longitudinal cross section of the FIG. 6 dual vial adapter assemblage along line D-D in FIG. 8A.

FIG. 5A to FIG. 5F show the use of the administration set 5 for preparing a liquid drug in a drug vial 20 ready for administration to a patient. FIG. 5A shows telescopic mounting the second vented female vial adapter 120 on the liquid vial 30 for puncturing same. FIG. 5B shows inverting the dual vial adapter assemblage 100 together with the attached liquid vial 30 and telescopically mounting the first vented female vial adapter 110 on the drug vial 20 for puncturing same thereby leading to gravitational flow of liquid contents from the liquid vial 30 to the drug vial 20 to form a liquid drug therein and venting of air displaced from the drug vial 20 to the liquid vial 30. FIG. 5C shows unscrewing the liquid transfer coupler 130 from the first vented female vial adapter 110. FIG. 5D shows screwing the syringe 10 onto the first vented female vial adapter 110 for aspirating a liquid drug dosage from the drug vial 20 for administration to a patient. FIG. 5E shows removal of the first vented female vial adapter 110 from the drug vial 20. FIG. 5F shows connection of the IV infusion set 40 to the drug vial 20 for infusion of liquid drug to the patient.

FIG. 6 to FIG. 9 show a dual vial adapter assemblage 200 similar in construction and operation as the dual vial adapter assemblage 100. The latter 200 differs from the former 100 in terms of the engagement of the liquid transfer coupler 130 to the first vented female vial adapter 110 and the second vented female vial adapter 120. Instead of the deployment of the opposite pair of engagement grooves and outward directed engagement projections 132A, and the opposite pair of engagement grooves 128A and outward directed engagement projections 132B, the air lumen wall 132 includes an internal first screw thread 139A for engaging the first vented female vial adapter female connector 113 and an internal second screw thread 139B for engaging the second vented female vial adapter female connector 123.

While particular embodiments of the present invention are illustrated and described, it would be obvious to those skilled in the art that various other changes and modifications can be made without departing from the spirit and scope of the invention.

The invention claimed is:

1. A dual vial adapter assemblage for use with a drug vial and a liquid vial, the drug vial having a drug vial bottle and a drug vial stopper sealing the drug vial bottle, the drug vial containing a medicament, the liquid vial having a liquid vial bottle and a liquid vial stopper sealing the liquid vial bottle, the liquid vial containing liquid contents for mixing with or reconstituting the medicament in the drug vial to form a liquid drug therein, the dual vial adapter assemblage having a longitudinal dual vial adapter assemblage centerline and comprising:

a first vented female vial adapter for telescopic mounting on the drug vial, the first vented female vial adapter having a longitudinal first vented female vial adapter centerline and including:

a transverse first vented female vial adapter top wall with an upright first vented female vial adapter female connector and at least one first vented female vial adapter top wall vent radial outward from said upright first vented female vial adapter female connector relative to said longitudinal first vented female vial adapter centerline, a first vented female vial adapter skirt for telescopic mounting on the drug vial, and a first dual lumen vial stopper puncturing cannula for puncturing the drug vial stopper on said telescopic mounting said first vented female vial adapter on the drug vial, said first dual lumen vial stopper puncturing member including a first liquid lumen in flow communication with said upright first vented female vial adapter female connector and a first air lumen in flow communication with said at least one first vented female vial adapter top wall vent;

a second vented female vial adapter for telescopic mounting on the liquid vial, the second vented female vial adapter having a longitudinal second vented female vial adapter centerline and including:

a transverse second vented female vial adapter top wall with an upright second vented female vial adapter female connector and at least one second vented female vial adapter top wall vent radial outward from said upright second vented female vial adapter female connector relative to said longitudinal second vented female vial adapter centerline, a second vented female vial adapter skirt for telescopic mounting on the liquid vial, and a second dual lumen vial stopper puncturing cannula for puncturing the liquid vial stopper on said telescopic mounting said second vented female vial adapter on the liquid vial, said second dual lumen vial stopper puncturing member including a second liquid lumen in flow communication with said upright second vented female vial adapter female connector and a second air lumen in flow communication with said at least one second vented female vial adapter top wall vent; and a tubular liquid transfer coupler having a longitudinal liquid transfer coupler centerline and including a first liquid transfer coupler end for coupling to said first vented female vial adapter and a second liquid transfer coupler end for coupling to said second vented female vial adapter for establishing a dual sealed lumen arrangement between said first vented female vial adapter and said second vented female vial adapter, wherein said liquid transfer coupler includes a longitudinal air lumen wall enclosing a sealed air lumen of said dual sealed lumen arrangement in flow communication with said at least one first vented female vial adapter top wall vent and said at least one second vented female vial adapter top wall vent, wherein said air lumen wall includes a first male connector for sealing insertion in said upright first vented female vial adapter female connector and an opposite directed second male connector for sealing insertion in said upright second vented female vial adapter female connector for establishing a central sealed liquid lumen between said first vented female vial adapter female connector and said second vented female vial adapter female connector, wherein said sealed air lumen is radial outward from said central sealed liquid lumen with respect to said longitudinal liquid transfer coupler centerline, and wherein telescopically mounting the first vented female vial adapter on the drug vial, telescopically mounting the second vented female vial adapter on the liquid vial, and placing the liquid vial above the drug vial enables gravitational flow of liquid contents from the liquid vial to the drug vial through said central sealed liquid lumen for forming liquid drug therein and venting of air displaced from the drug vial to the liquid vial through said sealed air lumen and, subsequent detaching of said first vented female vial adapter from said liquid transfer coupler enables attachment of a needleless syringe to said upright first vented female vial adapter female connector for aspiration of liquid contents therefrom.

2. The assemblage according to claim 1, wherein said first vented female vial adapter top wall includes an interior surround radial outward with respect to said at least one first vented female vial adapter top wall vent relative to said longitudinal first vented female vial adapter centerline and surrounding said upright first vented female vial adapter female connector, and an exterior surround surrounding said interior surround, wherein said second vented female vial adapter top wall includes an interior surround radial outward with respect to said at least one second vented female vial adapter top wall vent relative to said longitudinal second vented female vial adapter centerline and surrounding said upright second vented female vial adapter female connector, and an exterior surround surrounding said interior surround, and wherein said air lumen wall is sealingly inserted between said first vented female vial adapter top wall's interior surround and exterior surround at said first liquid transfer coupler end and said second vented female vial adapter top wall's interior surround and exterior surround at said second liquid transfer coupler end.

3. The assemblage of claim 1, wherein said sealed air lumen surrounds said central sealed liquid lumen.

4. The assemblage of claim 1, wherein said liquid transfer coupler includes an external wall mounted on said air lumen wall for assisting handling the assemblage.

5. The assemblage of claim 1, wherein said air lumen wall engages said first vented female vial adapter top wall at said first liquid transfer coupler end and said second vented female vial adapter top wall at said second liquid transfer coupler end.

6. The assemblage of claim 1, wherein said air lumen wall includes an internal first screw thread engaging said first vented female vial adapter female connector and an internal second screw thread for engaging said second vented female vial adapter female connector.

7. The assemblage of claim 1, wherein the air lumen wall has a pair of outward radially directed engagement projections configured to engage a pair of engagement grooves on the first vented female vial adapter.

8. The assemblage of claim 1, wherein the air lumen wall has a pair of outward radially directed engagement projections configured to engage a pair of engagement grooves on the second vented female vial adapter.

9. The assemblage of claim 1, wherein the air lumen wall includes an internal transverse flange having a first male connector and a second male connector.

10. The assemblage of claim 4, further comprising radial vanes extending between the air lumen wall and the external wall.

* * * * *